United States Patent [19]

Kovacs et al.

[11] Patent Number: 4,703,608

[45] Date of Patent: Nov. 3, 1987

[54] PACKAGING METHOD AND APPARATUS

[75] Inventors: Lloyd Kovacs, Sheboygan, Wis.; Dennis P. Horsman, Overland Park, Kans.

[73] Assignee: Hayssen Manufacturing Company, Sheboygan, Wis.

[21] Appl. No.: 823,106

[22] Filed: Jan. 27, 1986

[51] Int. Cl.[4] ..... B65B 5/06

[52] U.S. Cl. ..... 53/410; 53/223; 53/526; 53/572

[58] Field of Search ..... 53/410, 449, 436, 526, 53/527, 252, 223, 572, 571, 570

[56] References Cited

U.S. PATENT DOCUMENTS

| | | | |
|---|---|---|---|
| 2,705,584 | 4/1955 | Gilbert et al. | 53/572 X |
| 3,165,870 | 1/1965 | Saumsiegle et al. | 53/572 |
| 3,217,464 | 11/1965 | Feingold | 53/572 |
| 4,018,031 | 4/1977 | Smaw | 53/572 X |
| 4,553,668 | 11/1985 | James et al. | 206/391 |

FOREIGN PATENT DOCUMENTS

| | | | |
|---|---|---|---|
| 7414356 | 5/1975 | Netherlands | 53/572 |

*Primary Examiner*—James F. Coan

*Attorney, Agent, or Firm*—Senniger, Powers, Leavitt and Roedel

[57] ABSTRACT

Method of and apparatus for packaging product in a bag of flexible packaging material wherein a bag is sleeved on an open-ended carrier from one end thereof at a first station, product is loaded in the carrier from its other end, the bag and product lengths being such that the bag has a lip all around it at its mouth projecting beyond the product, the carrier is moved to a second station, a closure panel is inserted in the carrier through its said other end at the second station, the product and panel are pushed out of the carrier through its said one end, the bag coming off the carrier surrounding the product, and the bag with the product and panel therein are moved to a number of lip folding and sealing stations for folding over and sealing of the lip to said panel.

50 Claims, 29 Drawing Figures

PACKAGING METHOD AND APPARATUS

BRIEF SUMMARY OF THE INVENTION

This invention relates to the packing or handling of articles for storage and shipment, more particularly a method of and apparatus for such packing or handling of articles, and especially packages of rolls of paper, e.g. packages comprising a plurality of rolls of toilet paper wrapped in plastic film, or rolls of paper toweling, as in the coassigned U.S. Pat. No. 4,553,668 of Robert C. James and Lloyd Kovacs, issued Nov. 19, 1985, entitled Packaging Articles, Such as Rolls of Paper. The latter, which is incorporated herein by references, discloses a mode of packaging product, and more particularly rolls of toilet paper in case lots of ninety-six rolls, for use in place of packing the rolls in corrugated cases, with substantial savings in cost of material. This invention has for its object the provision of an improved method for carrying out the packaging of product as disclosed in and said U.S. patent, and the provision of apparatus for carrying out the improved method in mass production so as to maintain the cost savings in material.

In general, the invention is directed to packaging product having first and second ends in a bag of flexible packaging material formed with a first end closure at one end and an open mouth at the other, the method of the invention comprising loading the bag with product with the first end of the product at said first end closure of the bag, the length of the bag and the length of the product being such that, with said first end of the product at said first end closure of the bag, the bag has a lip all around it at its mouth projecting beyond the product. The method then proceeds to insertion of a closure panel in the bag to lie against the second end of the product, and pushing against the closure panel to push against the product and push the bag with the product and closure panel therein endwise to a position for transfer thereof for folding over and sealing the lip to the panel. Apparatus of the invention carries out this method, comprising means for loading the bag with product with the first end of the product at said first end closure of the bag, and means for inserting a closure panel in the bag to lie against the second end of the product and for pushing against the closure panel to push against the product and push the bag with the product and insert therein endwise to a position for transfer thereof for folding over and sealing the lip to the panel.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
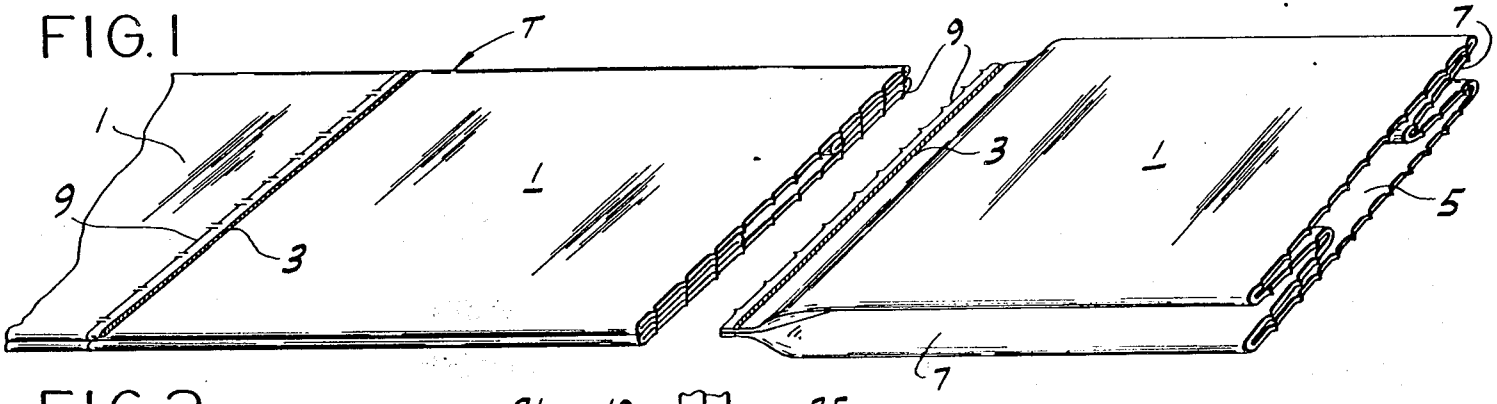
FIG. 1 is a view showing a bag used in conjunction with the invention separated from a continuous series of bags.

Referring to the drawings, first more particularly to FIG. 1, there is indicated at 1 a bag of flexible packaging material which is heat-sealable at least on the inside, and which in general is a polyethylene bag comprising a length of gussetted polyethylene tubing closed at one end constituting its bottom end by a heat seal as indicated at 3 extending completely across the bag to form a first end closure at one end thereof and open at its other end constituting its mouth end 5. The gussets of the bag, which are indicatd at 7, are relatively deep so that the bag, when packed as will appear, approaches the shape of a cube. As shown in FIG. 1, the bags are supplied in a continuous series, formed by providing the bag bottom heat seals 3 across continuous gussetted polyethylene tubing T at bag length intervals with lines of weakness 9, e.g., lines of perforations, extending transversely across the tubing adjacent each bag bottom heat seal 3 for facilitating the separation of each bag from the tubing, the open mouth of each bag occurring at the end of the separated bag opposite the heat-sealed bottom end. Being made of polyethylene, for example, the bag is stretchable.

Figure 3:
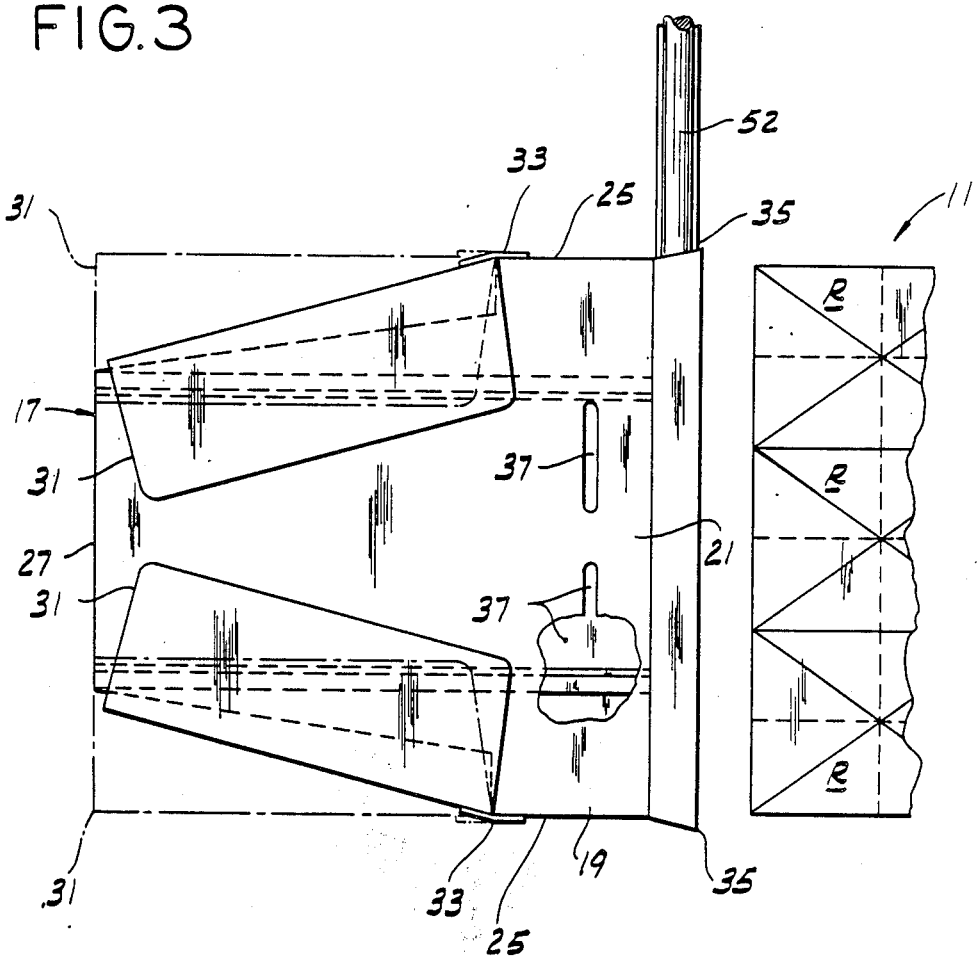
FIG. 3 is a plan view of part of FIG. 2, partly broken away to show interior detail.
Figure 4:
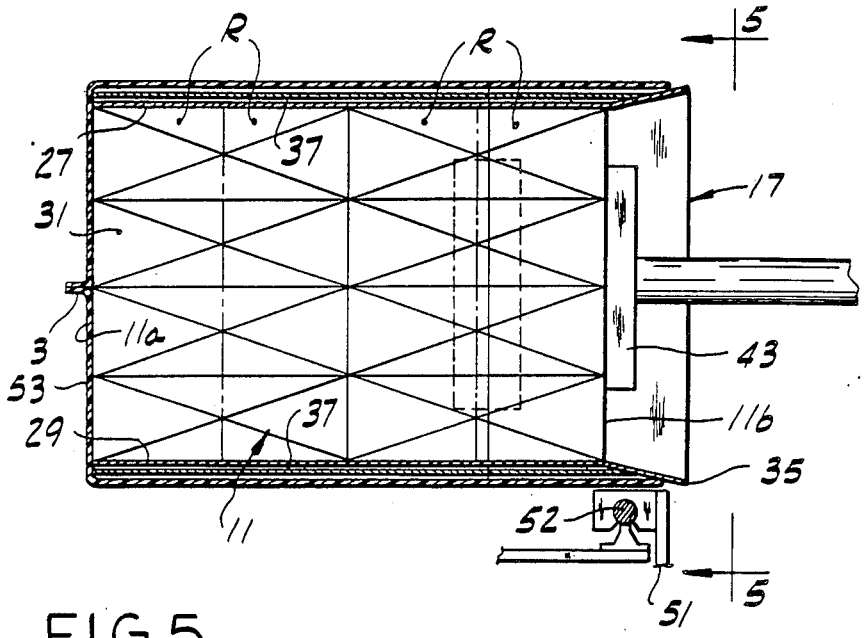
FIG. 4 is a view similar to FIG. 2 showing the packages entered (loaded) in the bag.
Figure 5:
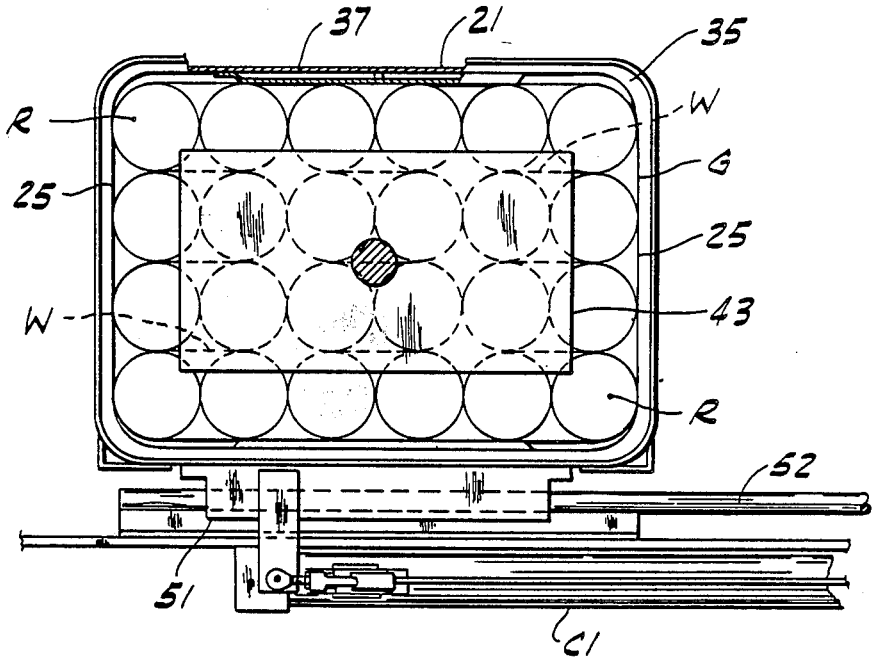
FIG. 5 is a view generally on line 5—5 of FIG. 4.
Figure 6:
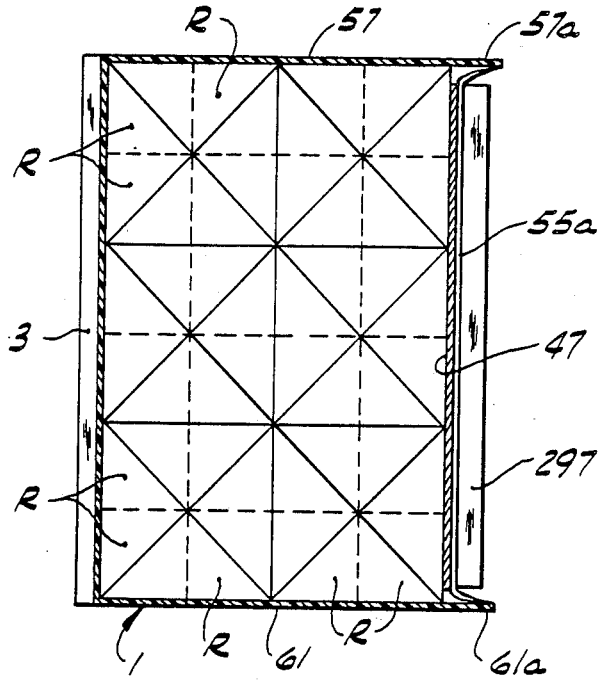
FIG. 6 is a view in section of the bag (with the packages therein and an end closure panel entered in the bag) at a first folding and sealing station where flaps at two opposite sides of the bag are folded over and sealed to the panel.
Figure 8:
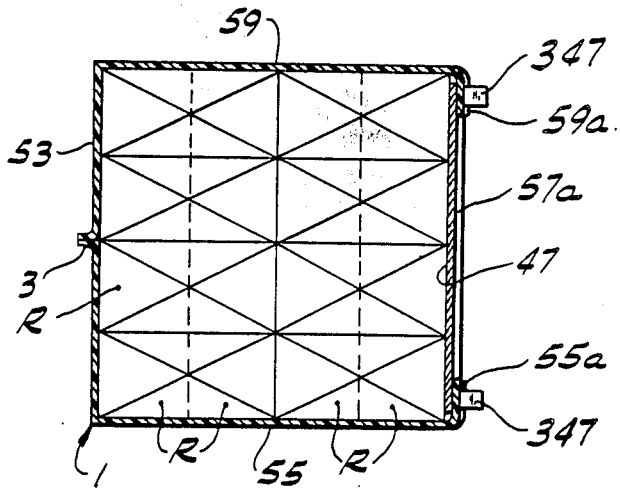
FIG. 8,is a view in section of the bag with the packages and panel therein at a second folding and sealing station where the flaps at the other two opposite sides of the bag are folded over and sealed to the panel.

Product indicated generally at 11 in FIGS. 2–6 and 8 is packed in the bag in a manner to be described. As herein illustrated, the product 11 comprises a set or collation of twenty-four packages 13 comprising four rolls R of toilet tissue arranged in two side-by-side rows of two rolls each, with the two rolls in each row arranged end-to-end, the four rolls being wrapped in polyethylene as indicated at W in FIG. 5. Such four-roll packages of toilet tissue, which are widely sold in the U.S.A., generally measure nine inches long, nine inches wide (at the widest) and four and one-half inches deep (each roll R generally being of four and one-half inches diameter and being four and one-half inches wide). The twenty-four packages are arranged as illustrated in FIGS. 2–6 and 8 in four layers, each layer comprising six packages arranged in three side-by-side rows with two packages arranged end-to-end in each row. Thus, the stack 11 of the twenty-four packages 13 in section transverse to the bag is generally rectangular, and measures generally eighteen inches endwise, twenty-seven inches widthwise and eighteen inches heightwise. One end of the product (the stack), referred to as its first end, is indicated at 11*a* and its other end, referred to as its second end, is indicated at 11*b*. Its girth, indicated at G in FIG. 5, is generally eighty-five inches. The girth of the bag is so related to the girth of the stack as to provide for a tight fit of the stack in the bag. The bag has a length, (in its FIG. 1 unpacked condition) of about thirty inches, which provides for a marginal portion or lip 15 of the bag at the bag mouth projecting about three inches beyond the end of the stack at the bag mouth when the stack 11 is fully inserted in the bag.

Figure 2:
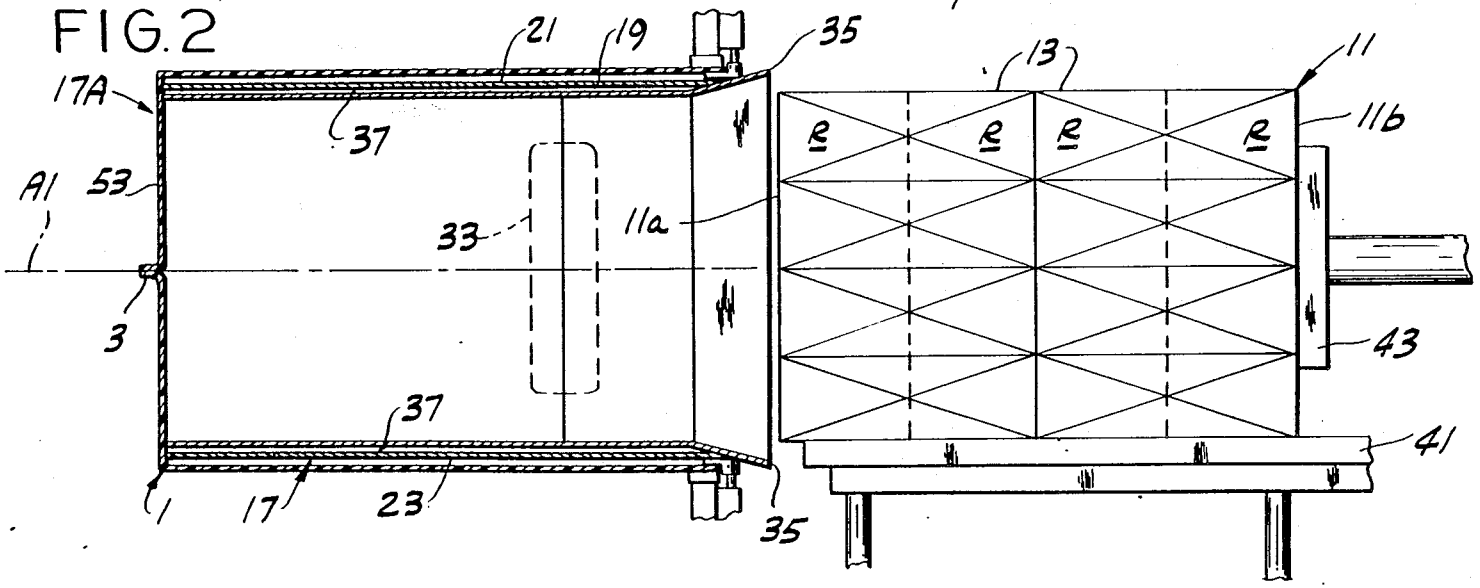
FIG. 2 is a view in section showing product comprising a stack of packages in position for being entered in a bag which has been pulled over a tubular bag and product carrier constituting part of the apparatus of the invention.

As shown in FIG. 2, a bag 1, separated from tubing T at a line of perforations 9, is pulled over or "sleeved" on a tubular bag and product carrier 17, which may also be referred to as the "loading funnel" or "stuffing tube" or "horn" of the apparatus. It is generally in the form of an open-ended tubular box structure of expansible and contractible construction as will appear, being contracted for facilitating pulling a bag thereover and being expanded on pushing a stack 11 thereinto. As shown in FIGS. 2–5, the carrier 17 has an end section 19 at one end thereof (which may be referred to as its loading end, and which is at the right in FIG. 3) of generally rectangular cross-section with rounded corners, this end section of the carrier having a top wall 21, bottom wall 23 and side walls each designated 25. The top and bottom walls have extensions 27 and 29, respectively, reaching to the other end of the carrier. The end section 19 is relatively narrow and the side walls 25 terminate well short of said other end of the carrier. The structure is completed by two side wall extensions each designated 31 hinged by means of leaf spring hinge members 33 to swing in and out, and normally biased by the leaf springs to swing in to the contracted position in which they are illustrated in FIG. 3 for the application of a bag to the carrier 17 by pulling the bag over the carrier from its said other end (which may be referred to as the bag pull-over end of the carrier and which is at the left in FIG. 3). When a bag has been applied to the carrier, a stack 11 is loaded into the carrier by pushing it thereinto from its said loading end, this end of the carrier being flared as indicated at 35 to funnel the stack 11 into the carrier. As the stack is pushed into the carrier, it expands the carrier, i.e. it forces the side wall extensions 31 of the carrier outwardly as indicated in phantom in FIG. 3. Air passageways are provided as indicated at 37 for exit of air from within the carrier and the bag as the stack is pushed into the carrier.

Figure 22:
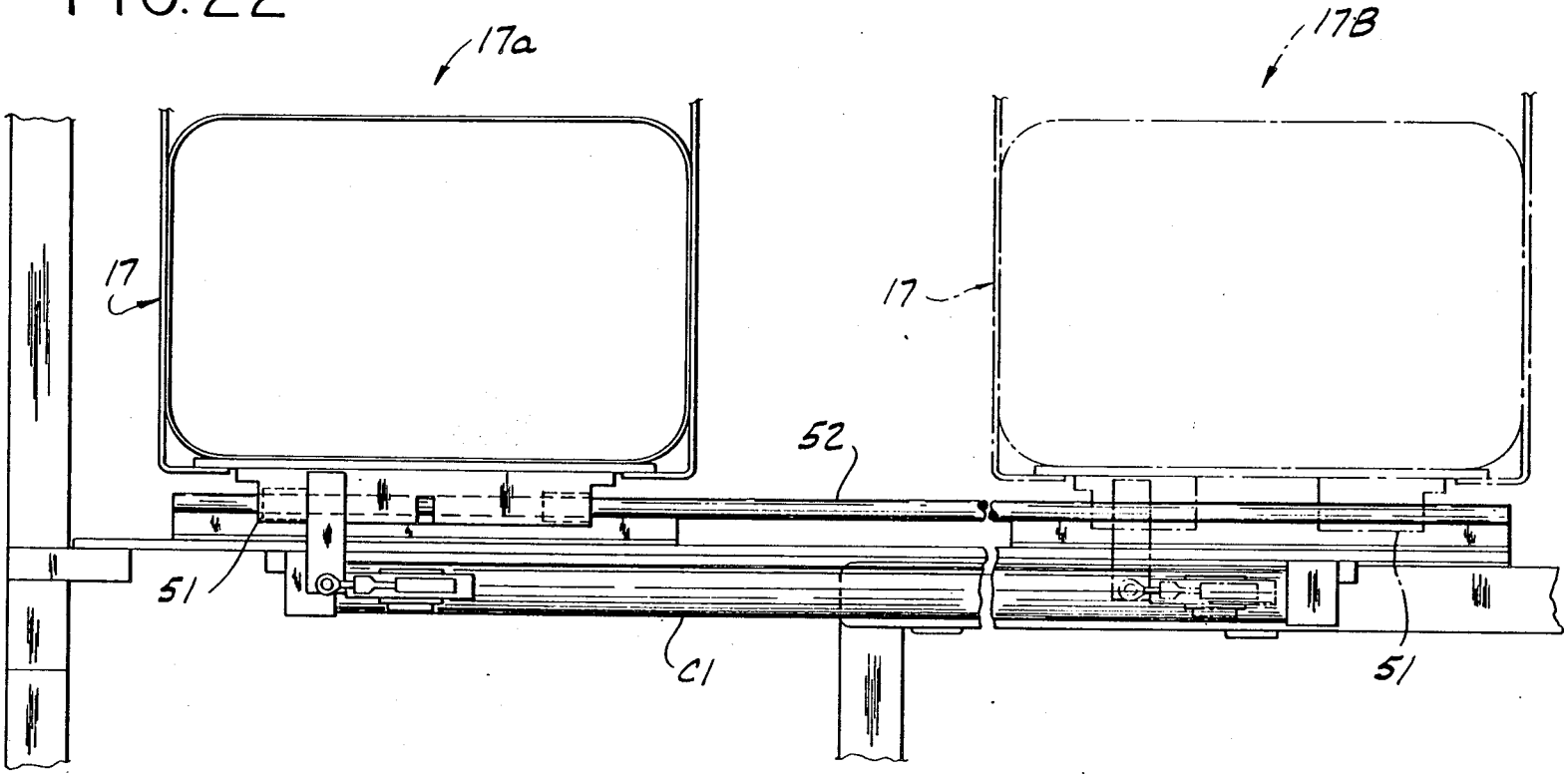
FIG. 22 is a view in elevation generally on line 22—22 of FIG. 14 and showing the two positions of the tubular bag and product carrier.

The carrier 17 is movable laterally (i.e. in the direction transverse to its axis) back and forth between a first carrier station 17A which may be referred to as the loading station, (see FIGS. 2, 10, 14 and 22) and a second carrier station 17B (see FIGS. 11 and 22) which may be referred to as the transfer or unloading station. In its first (loading) position at station 17A, the carrier 17 is located endwise between means indicated generally at 39 for separating a bag 1 from tubing T unwound from a roll RT, opening up the bag and pulling it over the carrier from the bag pull-over end of the carrier (the end opposite its flared end 35), and a holder indicated at 41 in FIG. 2 for a collated stack 11. Collation of the stack is by conventional means well known in the art for collating rolls of paper or packages of rolls into the stack (comprising ninety-six rolls in all). Associated therewith is a pusher 43 (the stack or product pushes) operable to push the stack into the carrier through its flared end 35. FIG. 2 shows the stack in position to be pushed into the carrier (with a bag thereon), and FIG. 4 shows the stack pushed into the carrier (with the bag thereon). The carrier 17, with the a bag 1 thereon and stack 11 therein is moved laterally from station 17A (see FIGS. 10 and 22) to station S2, (see FIGS. 11 and 22) where it is located endwise between a closure-panel-inserting and ram means 45 operable to pick up an insert or closure panel 47 from a stack 49 of said panels, insert the panel in the carrier, and push the stack endwise out of the carrier through its bag pull-over end, which is also its exit end. The carrier is somewhat longer than a bag and is cantilevered from a carriage 51, extending generally horizontally from said carriage toward said means 39 with its central longitudinal axis A1 generally horizontal.

Figure 7:
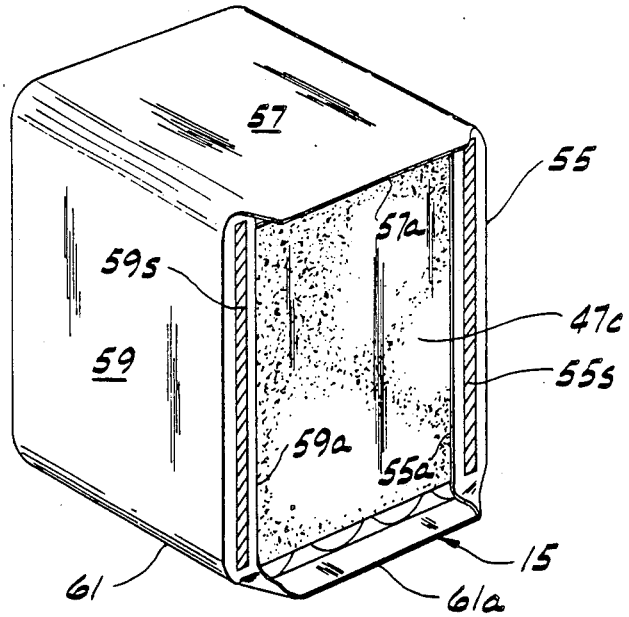
FIG. 7 is a perspective of FIG. 6 omitting sealing bars shown in FIG. 6.

The carriage 51 is slideable by means of an air-operated cable cylinder C1 (see FIGS. 5 and 22) on a rail 52 between the first station 17A, constituting the bag and stack receiving or loading station, and the second carrier station 17B, where the carrier (with the bag 1 thereon and the stack 11 therein) is in register with the closure-panel-inserting and ram means 45 for inserting a closure panel 47, picked up from the stack 49 of closure panels, in the bag and for the continuing movement of the closure panel to push the stack endwise out of the carrier with the panel 47 at the second (trailing) end 11*b* of the stack. The closure panel 47 comprises, for example, a piece of relatively thin sheet material, such as heavy paper (40–80 pounds per ream) or linerboard (100–140 pounds per ream) having generally the same shape as the shape of the end of the stack, i.e., generally rectangular with arcuate corners), and measuring about twenty-seven inches wide and eighteen inches high for the stack of twenty-four package as herein described, with a coating 47*c* (see FIGS. 7 and 9) of heat-sealable material, e.g., polyethylene, compatible for sealing with the material (polyethylene) of the bag, on one face of the panel constituting its outside face. The closure panel is applied flat against the second (outer) end 11*b* of the stack 11 in the bag with its heat-sealable face 47*c* on the outside, and the stack and the panel are pushed completely out of the carrier 17 through its exit end opposite its flared end 35. As the stack comes out of the exit end of the carrier, its first or leading end 11*a* engages the bottom 53 of the bag, spread out when the bag was sleeved on the carrier, and pushes the bag off the carrier, (i.e. it unsleeves the bag from the carrier). As the bag becomes unsleeved from the carrier, it becomes sleeved on the product, i.e., the stack 11, and as the bag (which was stretched on the carrier) comes off the carrier it contracts on the stack. Thus, the stack is loaded in the bag with the first end 11*a* of the stack at the first end closure 3 of the bag, the bag being stretched around the product to have four generally flat, rectangular sides 55, 57, 59 and 61, side 55 being opposite side 59 and side 57 being opposite side 61. The lip 15 projects beyond the panel 47, which is in engagement with the end of stack 11 adjacent the mouth of the bag, and provides four marginal portions of the bag at the mouth of the bag constituting flaps 55*a*, 59*a*, 57*a* and 61*a* at the mouth end of the sides projecting beyond end 11*b* of the stack. The flaps are disposed at each of the four edges of the panel 47. Each flap at any point thereof is of relatively narrow width substantially less than half the distance across the panel from said point.

As the bag comes off the carrier 17, with the stack 11 and the closure panel 47 therein lying against end 11*b* of the stack, it enters a compartment 63 of a series of compartments of a rotary indexing conveyor 65 constituted by a wheel (or turret) 65 (see FIGS. 10 and 13) in what may be referred to as the lip or flap folding and sealing zone 67 of the apparatus. As illustrated, this wheel (or turret) has four such compartments each designated 63 spaced at 90° intervals around the wheel axis A2, which extends horizontally above and parallel to axis A1 of the carrier 17 considering the carrier in position at station 17B. Means indicated generally at 69 is provided for indexing the wheel in 90° steps for indexing of each compartment 63 from a first index position or compartment station 63A in line with the S2 carrier position successively to index positions (or compartment stations) 63B, 63C and 63D and then back to the first position 63A. The compartment 63 at 63A is positioned to receive the bag 1 as it comes off carrier 17 at position S2 with stack 11 and panel 47 in the bag. Means indicated generally at 71 (see FIGS. 10, 11, 13, 24 25 and 26) is provided at index position 63B for folding over the flaps 55*a* and 59*a* on the outside of the panel 47 in the bag 1 and sealing these flaps to the panel 47. Means indicated generally at 73 is provided at index position 63C for folding over the flaps 57*a* and 61*a* on the outside of the panel 47 and sealing these flaps to the panel 47 to complete the formation of package P as illustrated in said U.S. Pat. No. 4,553,668 and as illustrated herein in FIG. 9. And means indicated generally at 75 is provided at index position 63D for ejecting the completed package P from the compartment 63 at that position.

Figure 10:
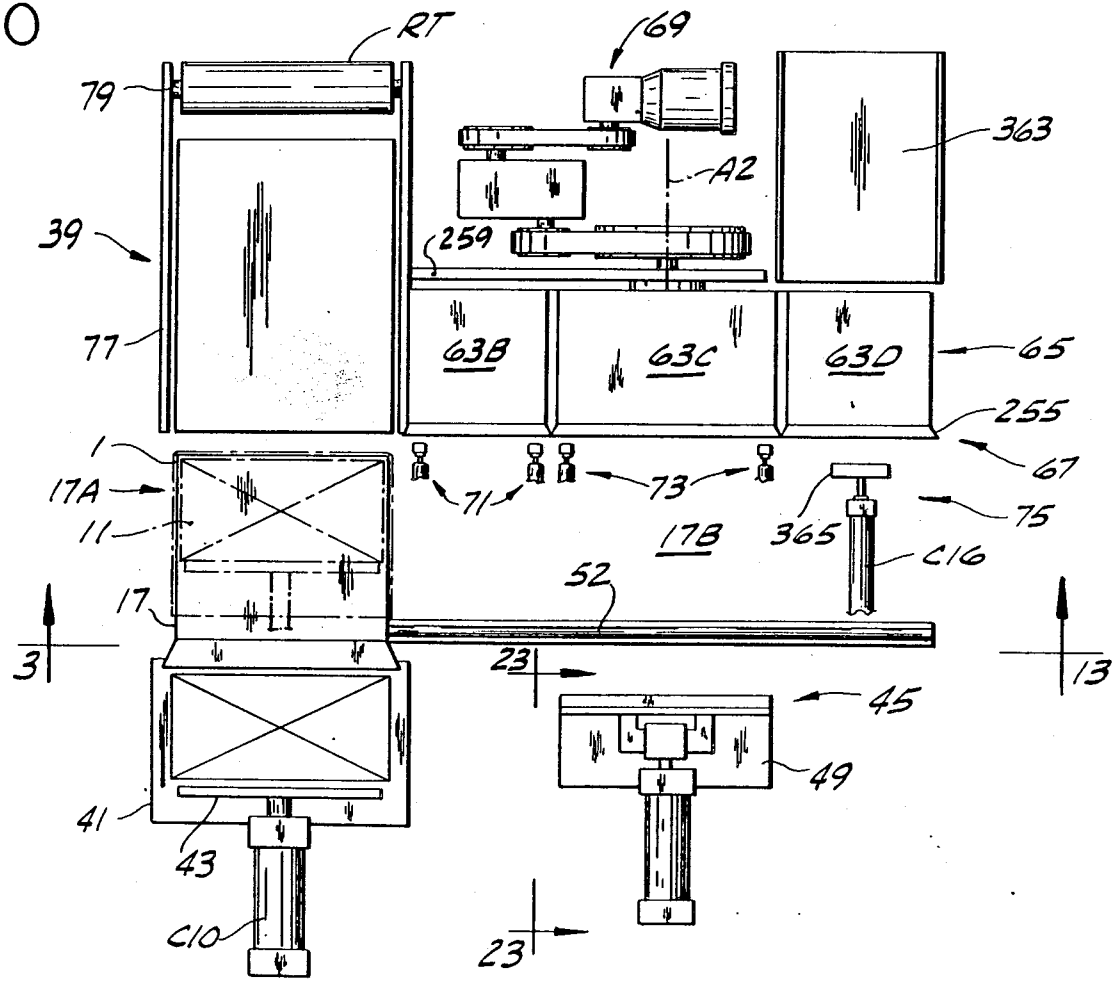
FIG. 10 is a semi-diagrammatic plan view of the apparatus of this invention, showing the tubular bag and product carrier of the apparatus at a loading station.
Figure 14:
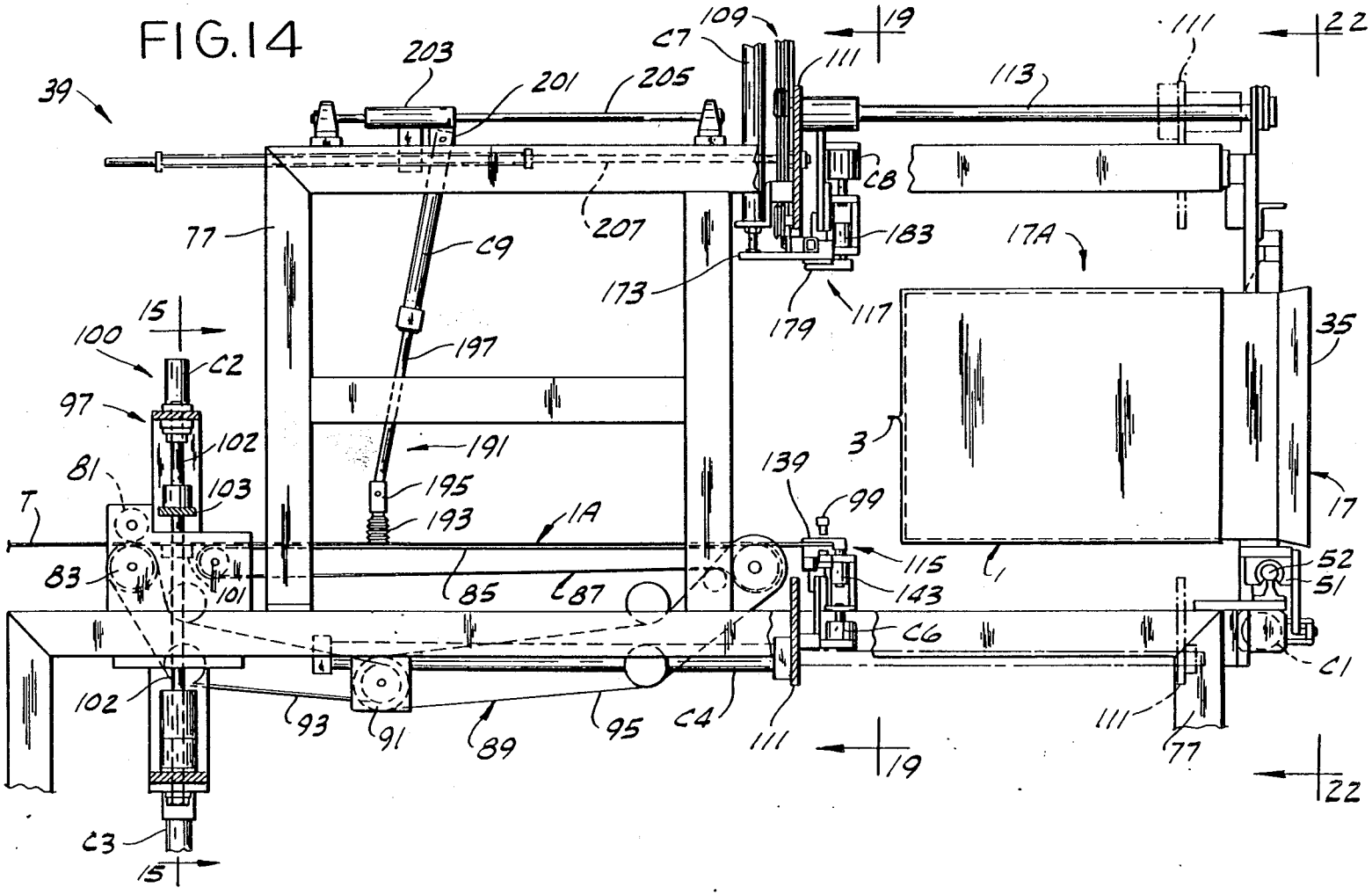
FIG. 14 is a view in side elevation of a subassembly of the apparatus for unwinding tubing from a role of tubing, separating a bag from the tubing (as in FIG. 1), opening up the bag, and pulling it over the carrier.

The means 39 for separating a bag B from tubing T unwound from roll R, opening up the bag, and pulling it over the carrier 17 (the carrier being at its stated first station S1) comprises a frame 77 having means such as generally indicated at 79 in FIG. 10 for supporting a roll RT of the tubing T and a pair of feed rolls 81 and 83 (see FIG. 14) for pulling the tubing T from the roll and feeding it forward, which is toward the right as viewed in FIG. 14. The tubing T (in flat condition) exiting from the rolls 81 and 83 extends forward over the upper reach of belts 85 of an endless belt conveyor 87. At 89 is indicated a drive system for the rolls and belts comprising an electric motor drive unit 91 driving the feed roll 83 via a drive 93 and driving the belt conveyor 87 via a drive 95. In the operation of the apparatus, the feed rolls 81, 83 and belts 85 are operated to feed forward such a length of the tubing as to bring a line of perforations 9 in the tubing to a severing station 97 downstream from the feed rolls and between the feed rolls and the upstream end of the upper reach of the belts 85 of the conveyor 87. The length of feed for this purpose is determined by an electric eye sensor indicated at 99 in FIG. 14 operable to stop the feed roll and belt drive unit 91 when the leading end of the tubing T reaches the sensor.

Figure 15:
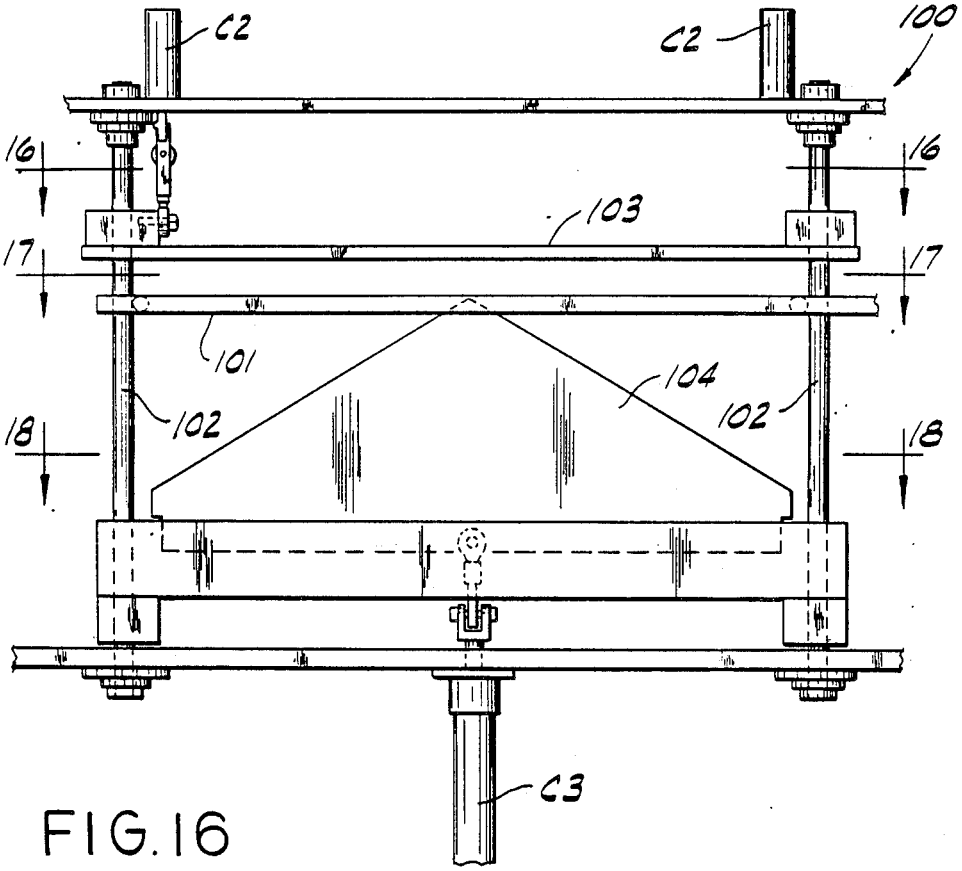
FIG. 15 is an enlarged verical transverse section on line 15—15 of FIG. 14.
Figure 16:
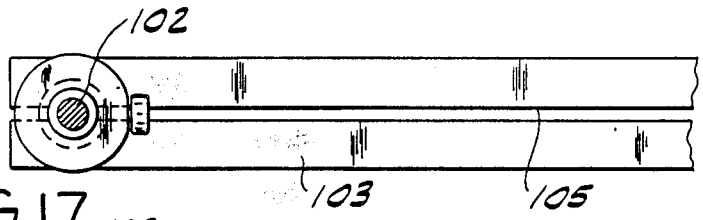
FIGS. 16–18 are partial and enlarged horizontal sections on lines 16—16, 17—17 and 18—18, respectively, of FIG. 15.
Figure 17:
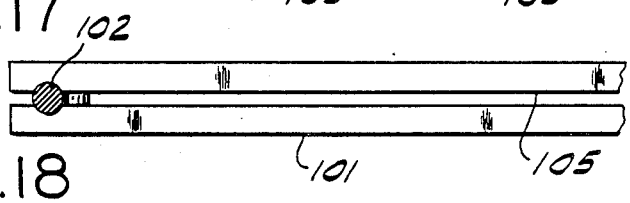
Figure 18:
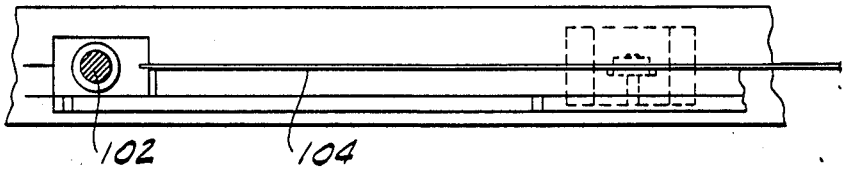
Figure 19:
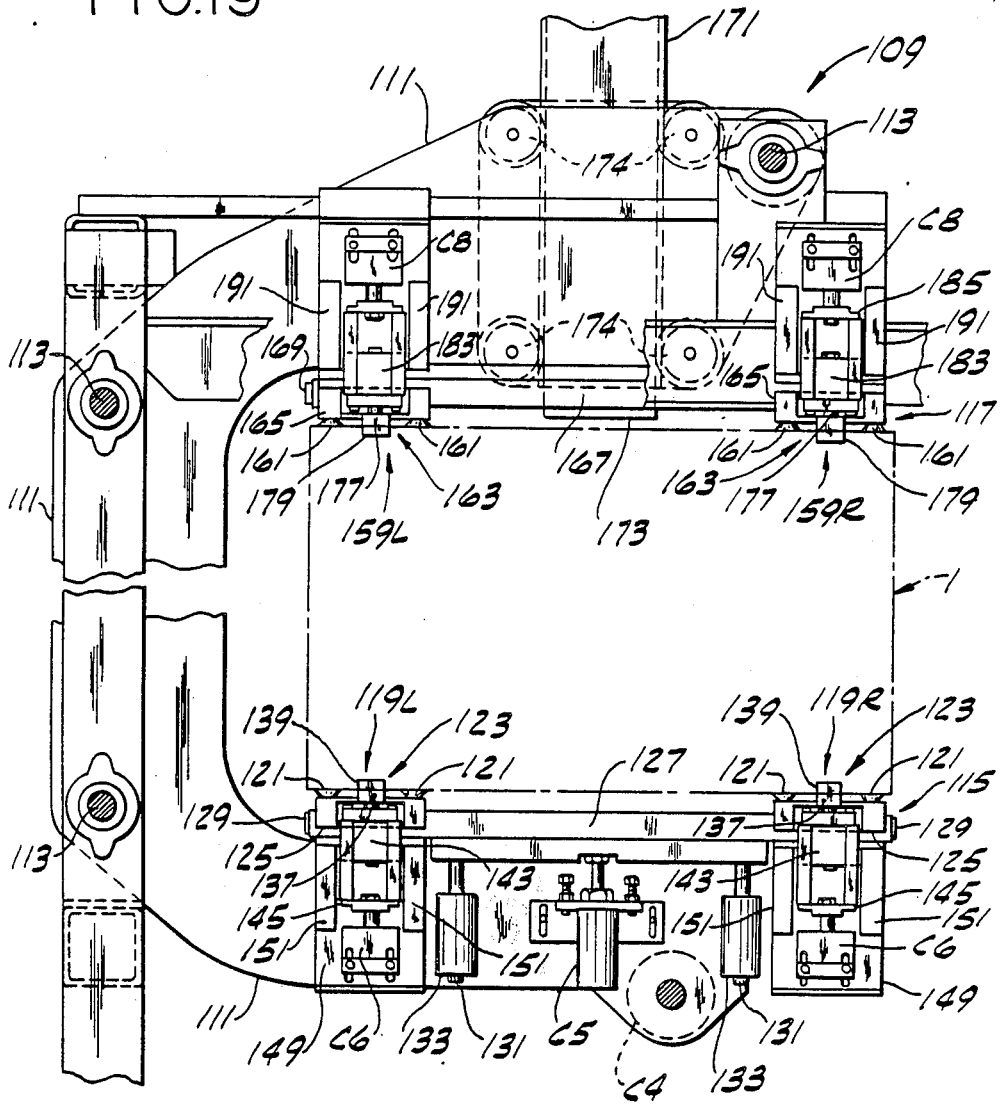
FIG. 19 is an enlarged vertical transverse section on line 19—19 of FIG. 14.

The stated length of tubing T, so fed forward, stops in a position which may be referred to as the bag pick-up positon extending forward from the feed rolls 81, 83 over the belts 85 generally to the electric eye sensor 99. With said length of tubing in this position, the tubing is firmly clamped in place by clamp means indicated generally at 100 in FIGS. 14 and 15 located between the feed rolls and the upstream end of the belt conveyor and comprising a lower clamp bar means 101 fixed on vertical rods 102 and an upper clamp bar means 103 slidable up and down on the rods by means of a pair of air cylinders C2. The tubing, thus clamped, is segmented at the line of perforations 9 between the feed rolls and the upstream end of the upper reach of the belts by means of a triangular cutting or segmenting blade 104 movable upwardly on rods 102 from a lowered retracted position at station 97 by an air cylinder C3. The lower and upper clamp bar mean 101 and 103 are slotted as indicated at 105 for passage of the blade 104. Thus, a bag 1 is separated from the tubing and rests momentarily in the pick-up position 1A in which it is illustrated in FIG. 14 on the belts 85 with its leading end, which is its open mouth end, at the electric eye sensor 99 and its trailing end, which is its end at the seal 3, at slots 105 between the feed rolls 81, 83 and the upstream end of the upper reach of belts 85.

At 109 (FIGS. 14 and 19–21) is generally indicated means for opening up the bag 1 which is at position 1A at its mouth and pulling the bag over the carrier 17, the latter being at the first carrier station S1. This bag opening and pulling means comprises a C-shaped yoke or carriage 111 constituted by a C-shaped plate mounted on horizontally extending guide rods 113 for linear sliding movement back and forth between the retracted position in which it is illustrated in solid lines in FIG. 14 adjacent the mouth end of the bag in the bag pick up position 1A and the advanced position illustrated in phantom in FIG. 14 in which it is adjacent the flared end 35 of the carrier 17, encompassing the top, one side and the bottom of the carrier. The yoke or carriage 111 is reciprocable between its said retracted and advanced positions by an air cylinder C4 and carries means indicated generally at 115 for gripping the bottom wall of the bag 1 which is in the bag pickup position adjacent the mouth end of the bag and holding it down and pulling the bag forward, and means indicated generally at 117 for gripping the top wall of the bag adjacent the mouth of the bag and pulling the top wall up away from the bottom wall for opening up the bag and for pulling it forward for sleeving the bag on the carrier 17.

Figure 20:
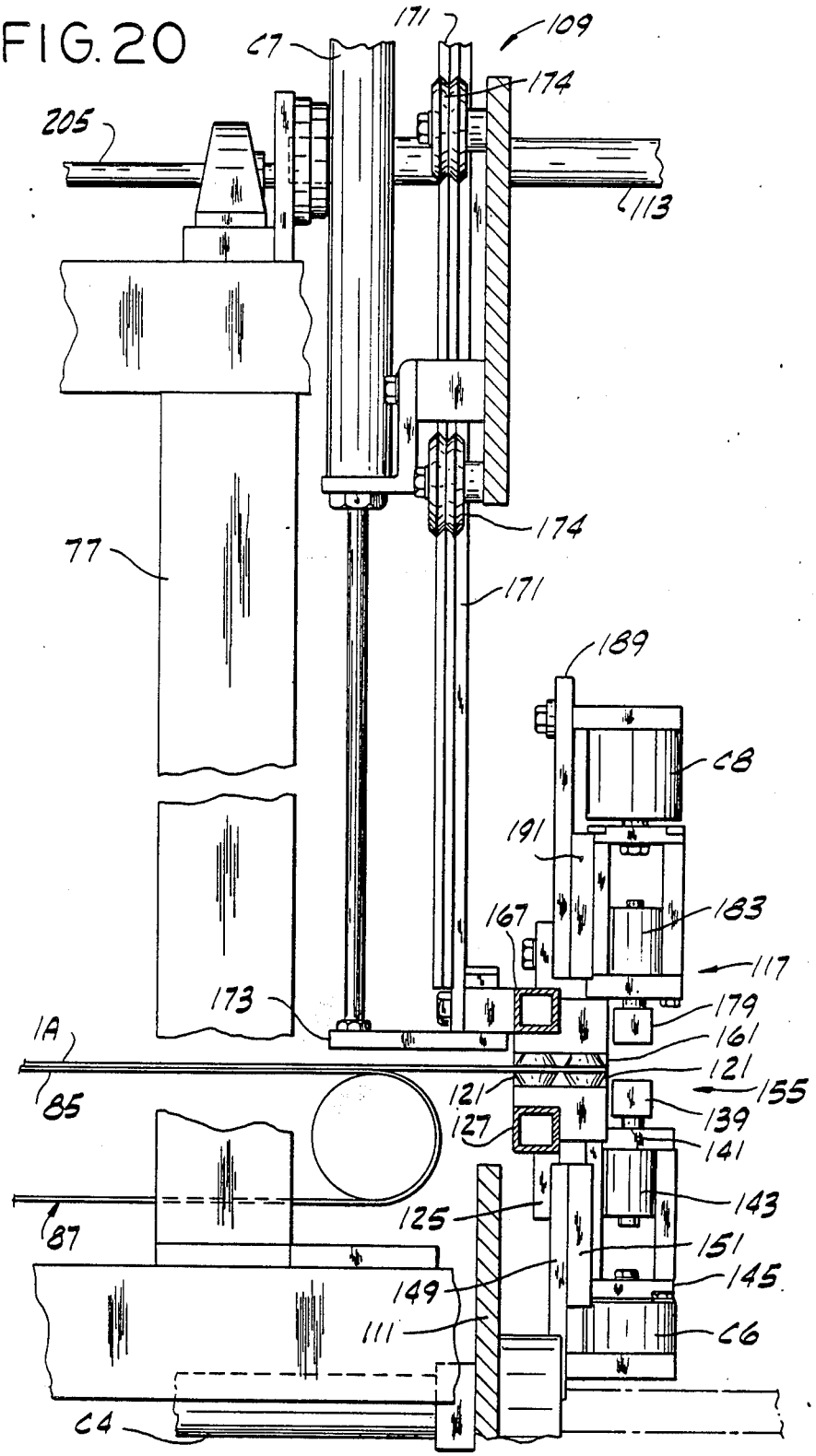
FIG. 20 is an enlargement of part of FIG. 14 with parts broken away and shown in section, and showing upper bag gripping means of the apparatus in a lowered position for the gripping of a bag to open it for application to the carrier.

More particularly, the means 115 on the carriage 111 for gripping the bottom wall of the bag comprises a left-hand gripper unit 119L and a right-hand gripper unit 119R, each of which comprises upwardly facing vacuum grippers each designated 121, also and a mechanical clamp means 123 mounted on the lower arm of the carriage. Left and right-hand are here used as viewed in FIG. 19. The vacuum grippers 121 of each gripper unit 119L and 119R are mounted on a bracket 125 secured to an elongate vacuum manifold 127 constituted by a tubular member of rectangular cross section having its ends closed as indicated at 129. There are four vacuum grippers 121 in each gripper unit arranged in spaced-apart pairs. The two brackets 125 are mounted on the manifold 121 adjacent its closed ends 129. The vacuum grippers 121 are in communication with the vacuum manifold 121, which is mounted for short-stroke up and down movement between a lowered retracted position wherein the vacuum grippers are below the plane of the bag 1 in the bag pick-up position 1A at the mouth end of the bag and a raised operative position (as shown in FIG. 20) wherein they engage the bottom face of the lower wall of the bag in the bag pick up position. This mounting is by means of a pair of guide means each comprising a guide rod 131 extending down from the manifold 127 vertically slidable in a guide 133 (see FIG. 19). The manifold is movable up and down betwen its stated retracted (lowered) and operative (raised) position by means of an air cylinder C5 having a relatively short stroke (e.g. a one-inch stroke).

Figure 21:
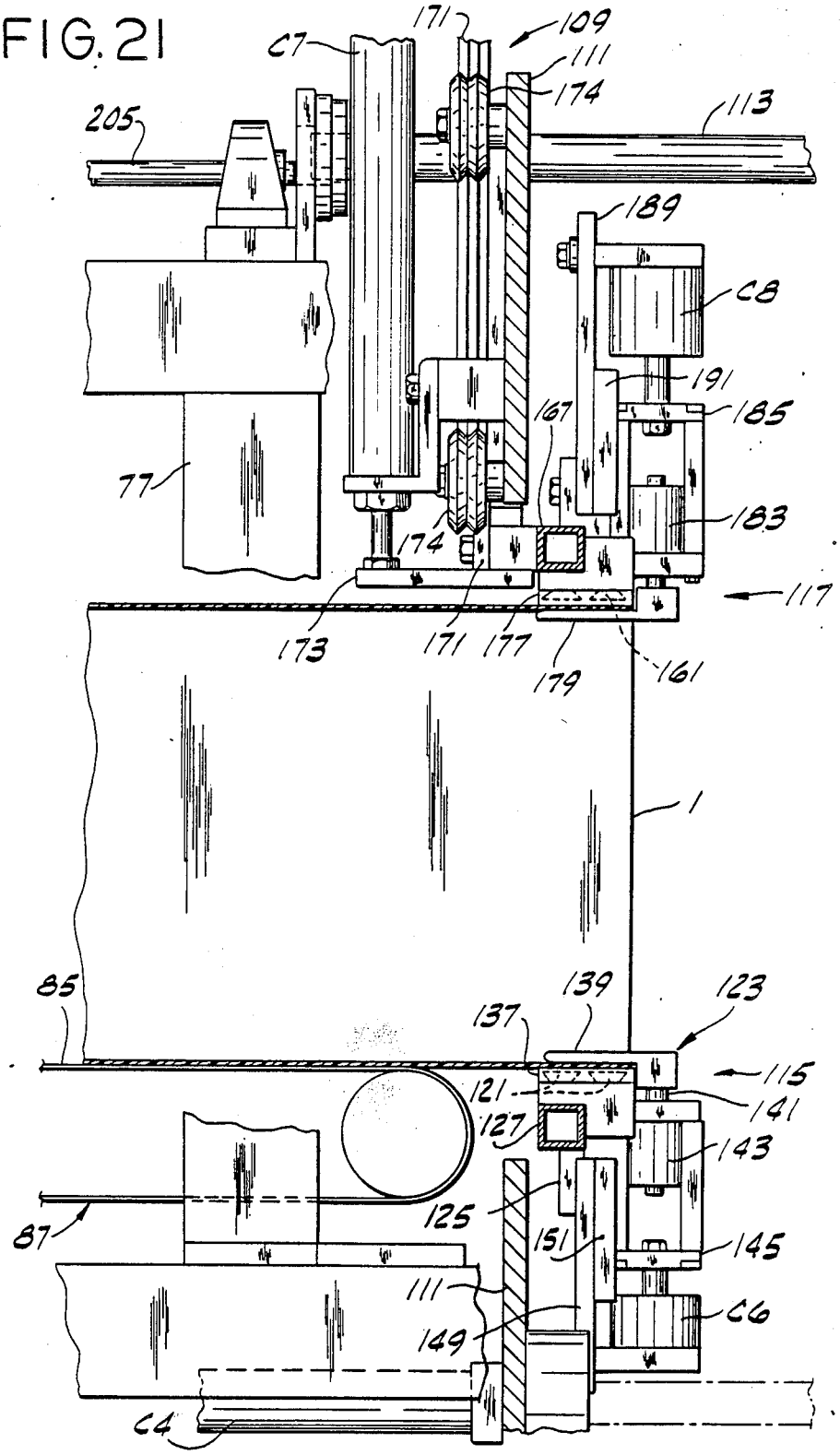
FIG. 21 is a view similar to FIG. 20 showing the upper bag gripping means raised to open the bag.

Each mechanical clamp means 123 is located between the two spaced-apart pairs of vacuum grippers 121 of a respective gripper unit 119L, 119R, comprising a lower jaw 137 mounted on the respective bracket 125 between the two pairs of vacuum grippers 121, and an upper jaw 139 which is movable up and down with the manifold 127, also movable up and down relative to manifold 127 between a raised (open) position above the lower jaw 137 and a lowered clamping position for mechanically clamping the lower wall of the bag 1 between the jaws, and also rotatable relative to the manifold 127 and lower jaw 137 between a retracted swung-out position clear of the lower wall of the bag 1 (see FIG. 20) and an operative swung-in position over the lower jaw 137 (see FIGS. 14 and 21). The up and down and rotational movement of the upper jaw 139 is effected by having the upper jaw secured to the upper end of the shaft 141 of an air-operated motor 143 adapted to rotate the shaft and the upper jaw 139 through 90° between its stated retracted and operative positions, with this motor carried by an elevator 145 movable up and down a short distance (e.g. ½ inch) by an air cylinder C6 mounted on a plate 149 extending down from the manifold 127. At 151 are indicated guides for the elevator on the mounting plate.

The means 117 on the carriage 111 for gripping the top wall of the bag is similar to the means 115 for gripping the bottom wall of the bag, comprising left and right hand gripper units 159L and 159R, each comprising downwardly facing vacuum grippers each designated 161, and a also a mechanical clamp means 163 mounted on the upper arm of the carriage 111. The vacuum grippers 161 of each upper gripper unit 159L and 159R are mounted on a bracket 165 secured to an elongate vacuum manifold 167 constituted by a tubular member of rectangular cross section having its ends closed as indicated at 169. There are four vacuum grippers 161 in each upper gripper unit arranged in spaced-apart pairs. The two brackets 165 are mounted on the manifold 167 adjacent its closed ends. The vacuum grippers 161 are in communication with the vacuum manifold 167, which is mounted for long-stroke up and down movement between a raised position wherein the vacuum grippers 161 are above the plane of the top of the carrier 17 (FIGS. 14, 19 and 20) and a lowered position (FIG. 21) wherein they engage the top face of the top wall of the bag 1 in the bag pick-up position. This mounting is by guide means comprising a vertical slide 171 extending up from a foot 173 for the manifold 167 and vertically slidable in guide rollers 174. The manifold 167 is movable up and down between its stated retracted and operative positions by means of an air cylinder C7 having a relatively long stroke (e.g. a twenty inch stroke).

Each mechanical clamp means 163 is located between the two spaced-apart pairs of vacuum grippers 161 of a respective gripper unit 159L, 159R, comprising an upper jaw 177 mounted on the respective bracket 165 between the two pairs of vacuum grippers 161 and a lower jaw 179 which is movable up and down with the manifold 167, also movable up and down relative to the manifold 167 between a lowered (open) position below the upper jaw 177 and a raised clamping position for mechanically clamping the top wall of the bag between the jaws 179 and 177, and also rotatable relative to the manifold 167 and upper jaw 177 between a retracted swung-out position clear of the top wall of the bag and an operative swung-in position below the upper jaw 177. The up and down and rotational movement of the lower jaw 179 is effected by having the lower jaw 179 secured to the lower end of the shaft 181 of an air-operated motor 183 adapted to rotate the shaft and the lower jaw through 90° between its stated retracted and operative positions, with this motor carried by an elevator 185 movable up and down a short distance (e.g. ½ inch) by an air cylinder C8 mounted on a plate 189 extending up from the manifold 167. At 191 are indicated guides for the elevator 185 on the mounting plate 189.

With the carriage 111 in its retracted (solidline) position of FIG. 14, with the lower gripper units 119L,R down (as a result of downward retraction of the lower manifold 127 by cylinder C5) and open, and with the upper gripper units 159L,R up and open, the leading end of a bag 1 in the bag pick-up position 1A extends forward over the vacuum grippers 121 of the lower gripper units. The lower manifold 127 is moved up by cylinder C5 to its FIG. 20 position for the gripping of the lower bag wall to the lower vacuum grippers 121 (see FIG. 20). The upper manifold 167 is moved down by air cylinder C7 for engagement of the vacuum grippers 161 of the upper gripper units with the top wall of the bag (see FIG. 20). Vacuum is applied so that the lower vacuum grippers 121 grip the bottom wall of the bag and the upper vacuum grippers 161 grip the top wall of the bag. The upper manifold 167 is raised by means of cylinder C7 so that the upper vacuum grippers 161 (associated with the upper manifold) pull up the top wall of the bag while the bottom wall is held down by the lower vacuum grippers 121, thereby opening up the bag at its mouth (see FIG. 21). When the top and bottom walls are separated, the lower clamp jaws 137 are moved up by cylinders C6 and swung around by motors 143 to closed position and then pulled down by cylinder C6 to grip the lower wall of the bag against jaws 137, and the upper clamp jaws 167 are moved down by cylinder C8 and swung around by motors 183 to closed position and pulled up by cylinders C8 to grip the upper wall of the bag against jaws 177. Then cylinder C4 is actuated to move the carriage 111 forward to pull the opened-up bag forward over the carrier 17 (at station S1) to sleeve the bag on the carrier.

At 191 in FIG. 14 is generally indicated means for picking up the top wall of the bag 1 adjacent the bag end closure 3 in conjunction with the picking up of the top wall of the bag at the mouth of the bag by the upper gripper units 159L,R on the carriage 111. This rear bag pickup means comprises a set of vacuum grippers 193 on a hollow crossbar 195 constituting a vacuum manifold for the grippers 193 at the lower end of a piston rod 197 extending down out of the lower end of an air cylinder C9 mounted at its upper end as indicated at 201 on a slider 203 slidable longitudinally of the apparatus above the belt conveyor 87 on guide rods 205 mounted on the frame 77 of the apparatus. The slider 203 is connected to the carriage 111 by a link 207, the arrangement being such that for the sleeving of a bag 1 on the carrier 17, the rear bag grippers 193 are moved down to grip the top of a bag in the bag pickup position, then raised by means of the air cylinder C9 along with the raising of the top wall of the bag by the gripper units 159L,R, and the slider 203, the cylinder C9 and grippers 193 are pulled forward by the carriage 111 as it moves forward.

Figure 11:
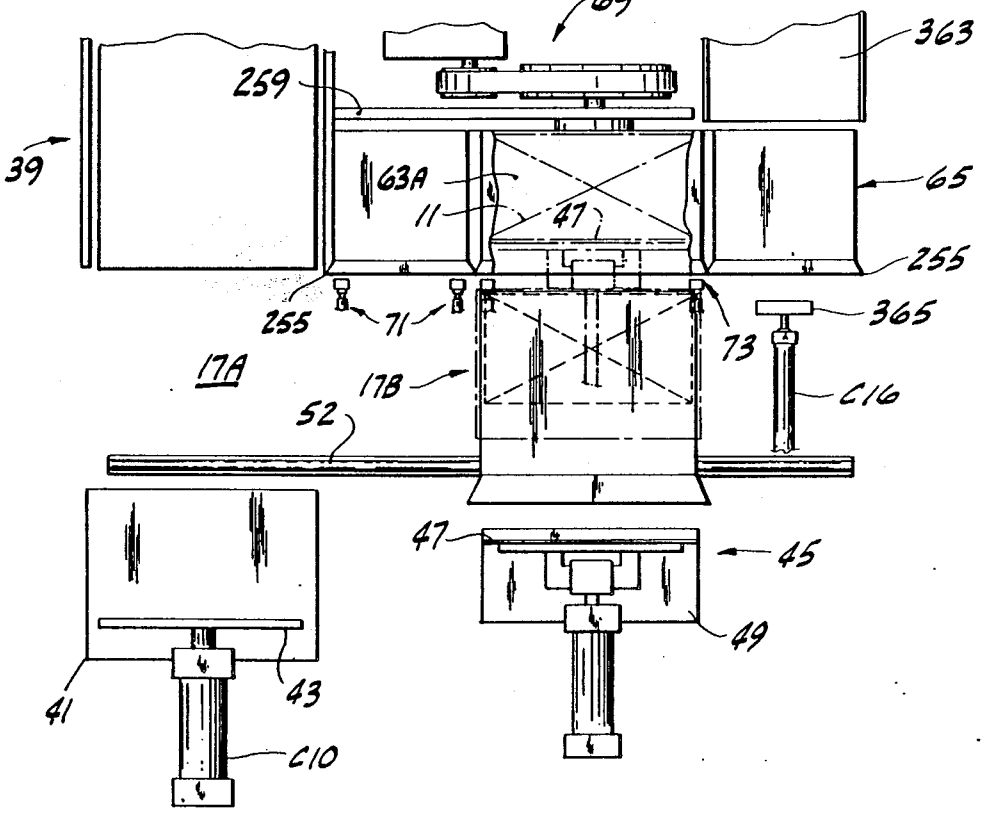
FIG. 11 is a view similar to FIG. 10, with parts broken away, showing in solid lines the bag and product carrier moved to a transfer or unloading station.
Figure 12:
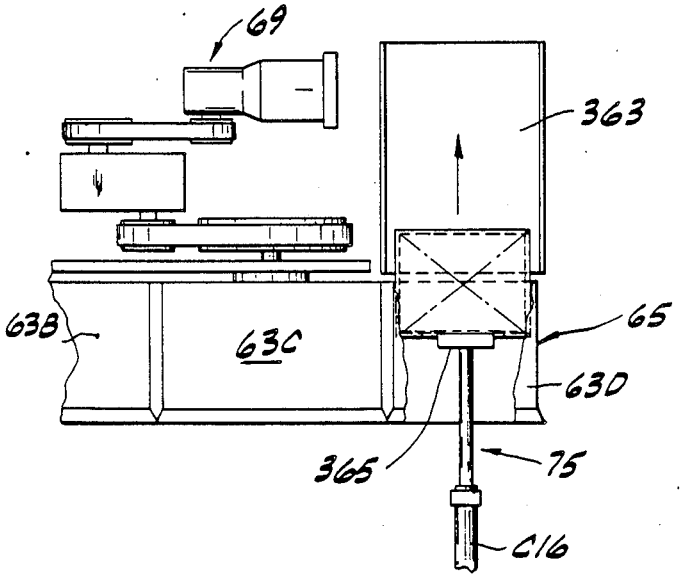
FIG. 12 is a fragment of FIG. 10 (and FIG. 11) with parts broken away showing how a completed package is discharged.
Figure 23:
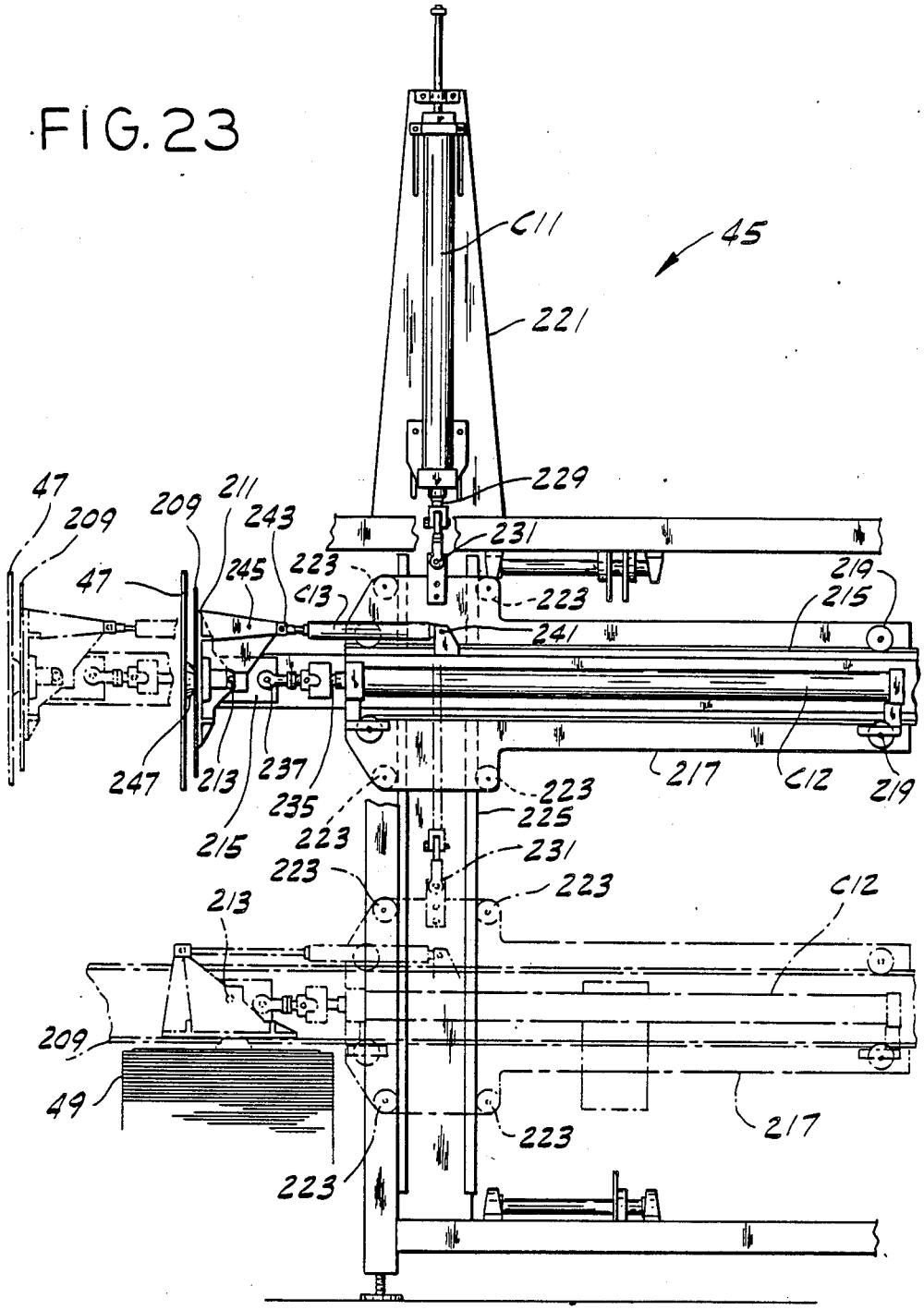
FIG. 23 is a view in elevation on line 23—23 of FIG. 10 showing an end closure panel inserting and pushing means of the apparatus.
Figure 24:
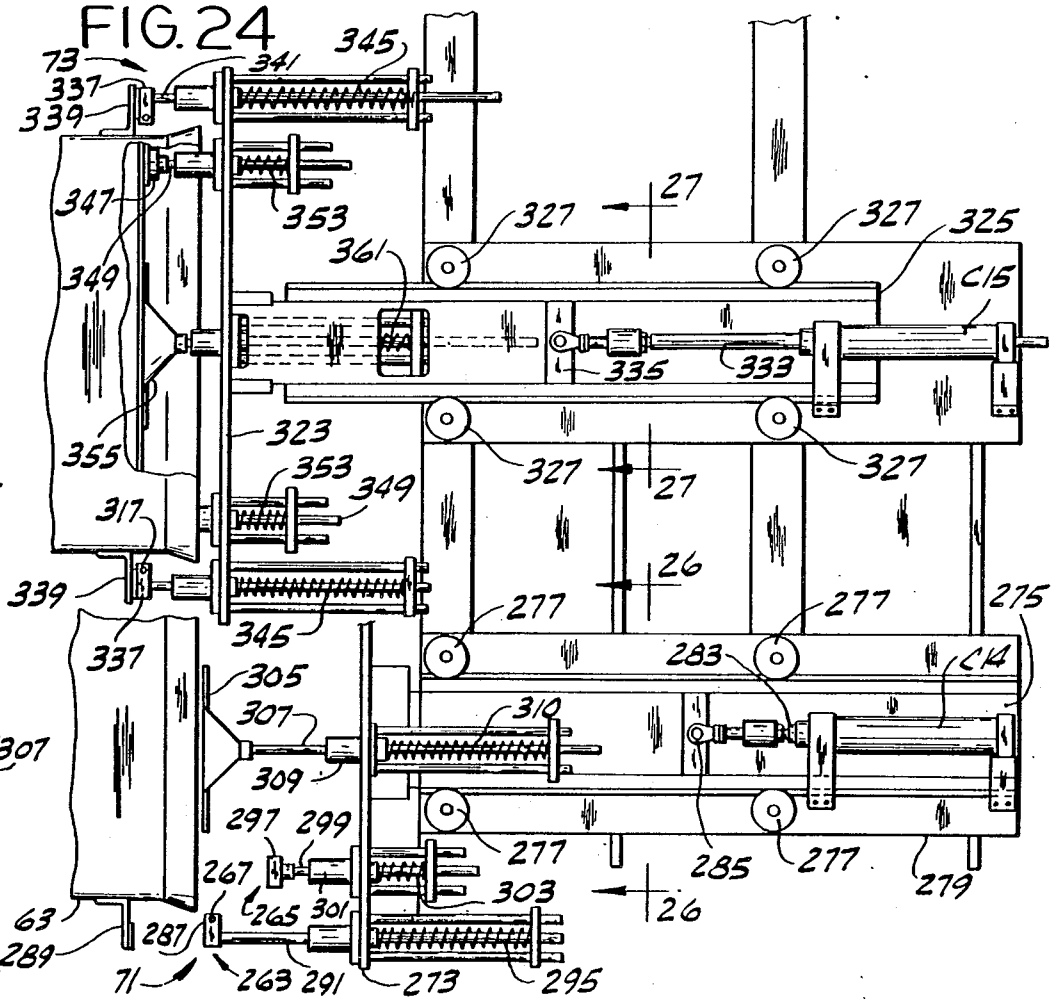
FIG. 24 is a plan view illustrating flap folding and sealing means of the apparatus.
Figure 25:
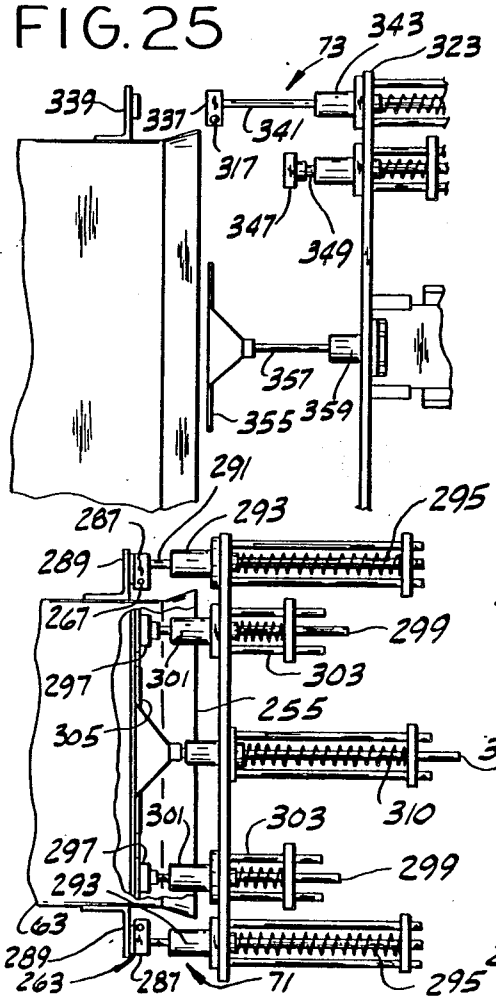
FIG. 25 is a fragment of FIG. 24 showing a moved position of parts.
Figure 26:
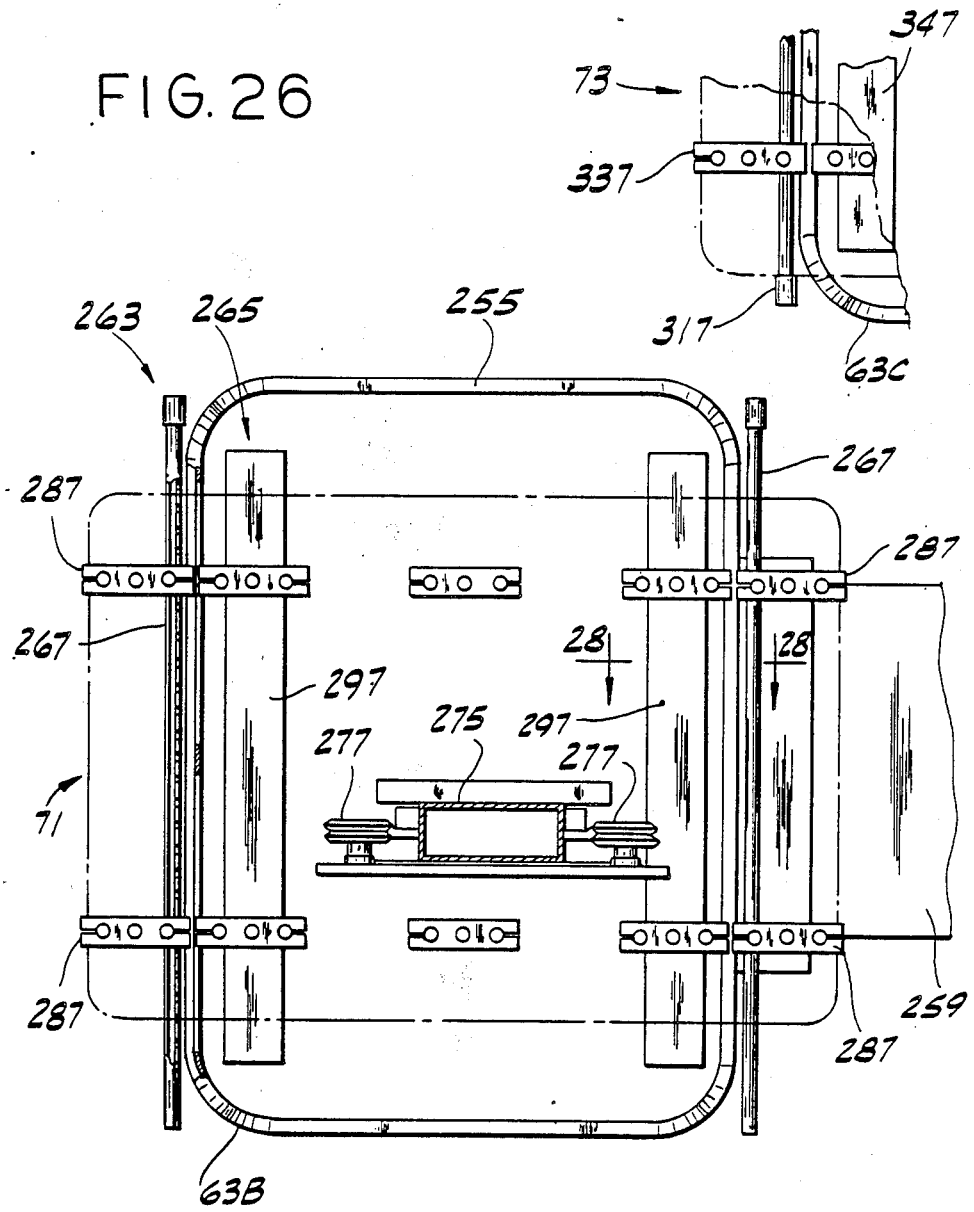
FIGS. 26 and 27 are views generally on lines 26—26, and 27—27, respectively of FIG. 24 on a larger scale than FIG. 24.
Figure 27:
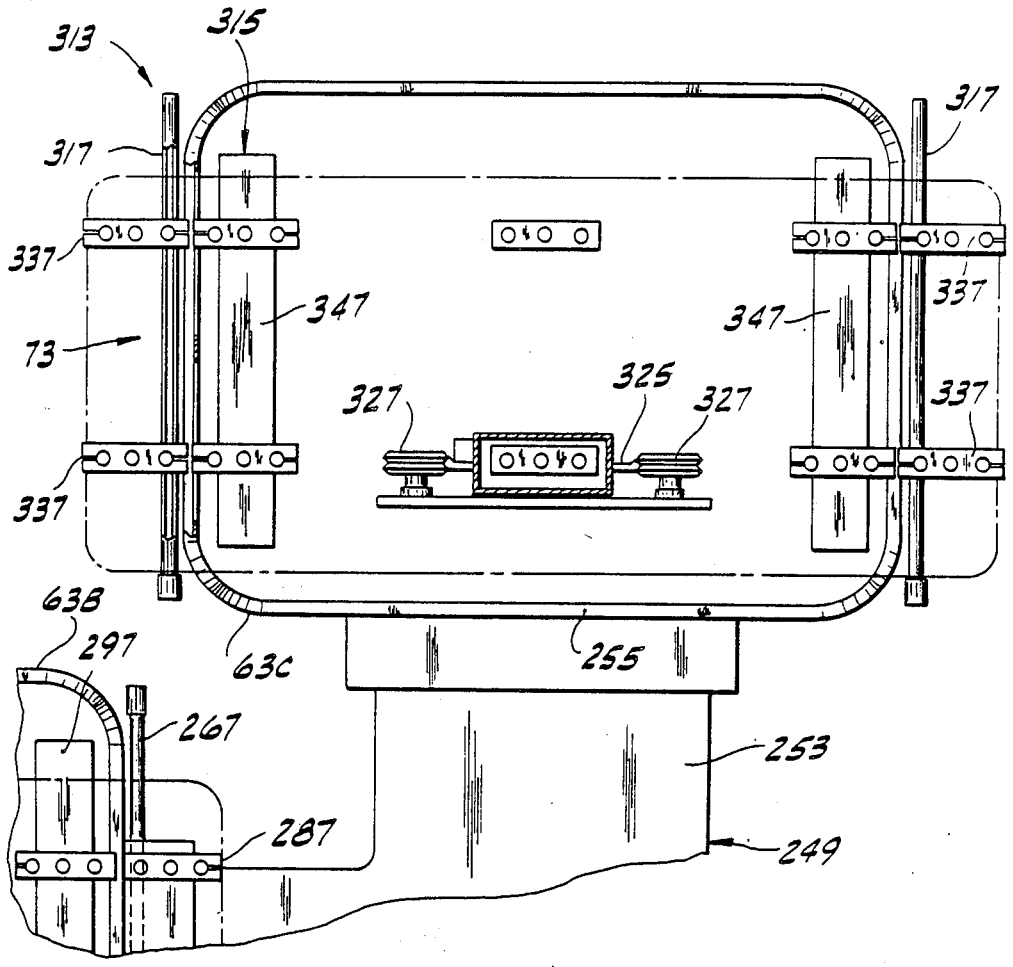

After the bag 1 has been sleeved on the carrier 17, and the stack 11 is pushed into the carrier by pusher 43, the latter being shown in FIGS. 10 and 11 as operated by an air cylinder C10, the carrier with the bag thereon and the stack therein is moved on the rail 52 by means of the cable cylinder C1 from the stated first carrier station S1 (the loading station) to the second carrier station S2 (the transfer station) where it is located endwise between the closure-panel-inserting and ram means 45 and a compartment 63 of the wheel 65 at index position 63A in line with the carrier. As shown in FIG. 23, the closure-panel-inserting and ram means 45 comprises a head 209 mounted for movement, as will appear, to pick up a closure panel 47 from the stack 49 of closure panels (as shown in phantom toward the bottom left of FIG. 23), then to a position as shown in solid lines in FIG. 23 in line with the carrier 17 at station S2, and then forward as shown in phantom at the left center of FIG. 23 to enter the panel in the carrier, and continuing movement further forward to push against the panel thereby to push the stack 11 out of the carrier 17, the stack 11 pushing the bag 1 off the carrier, the bag then encompassing the stack, and the bag with the stack and panel 47 therein entering the said compartment 63 of the wheel which is, at that time, at position 63A in line with the carrier 17. As will appear, position 63A is a position for transfer of the bag 1 with the product 11 and closure panel 47 therein for folding over and sealing of the lip 15 (flaps 55*a*, 59*a*, 57*a* and 61*a*) to the panel. The head 209 comprises a flat plate on a plate support casting 211 pivoted as indicated at 213 at the forward end of a slider 215 carried by an elevator 217 and guided by rollers as indicated at 219 for horizontal sliding movement relative to the elevator between the retracted position relative to station S2 in which it appears in solid lines in FIG. 23 and an advanced position for the insertion of the picked-up panel 47 in the carrier 17 at station S2 and the pushing of the stack 11 out of the carrier 17. The elevator 217 is mounted for up and down sliding movement on a frame 221 by means of rollers 223 on the elevator engaging a column 225 of the frame, the elevator being slidable up and down between the raised position in which it is illustrated in solid lines in FIG. 23 for the panel insertion and stack ramming operation, and the lowered position in which it is illustrated in phantom in FIG. 23 for the panel pickup. The raising and lowering of the elevator is effected by means of an air cylinder C11 mounted in vertical position on the frame 221 having its piston rod 229 extending from its lower end to a connection at 231 with the elevator. The latter carries a long-stroke air cylinder C12 extending horizontally alongside the slider 215, the piston rod 235 of this cylinder extending out of its forward end (its end toward station S2) to a connection at 237 with the slider. The head 209 is swingable on the axis of pivot 213 between the panel pickup position in which it is illustrated in phantom at the bottom left of FIG. 23 facing downwardly and the pushing or ramming position in which it is illustrated in solid lines in FIG. 23 by means of an air cylinder C13 pivoted at its head end as indicated at 241 on the slider extending toward the head and having its piston rod extending from its other (rod) end to a pin connection at 243 with the end of an elongate lug 245 formed as part of the head casting 211. Vacuum gripper means such as indicated at 247 is provided on the head 209 for vacuum gripping a panel on the face of the head. This may comprise a pair of vacuum cups mounted for movement between a retracted position in a recess in the head and an extended position as illustrated in solid lines in FIG. 23, and spring-biased out to their extended position.

Figure 13:
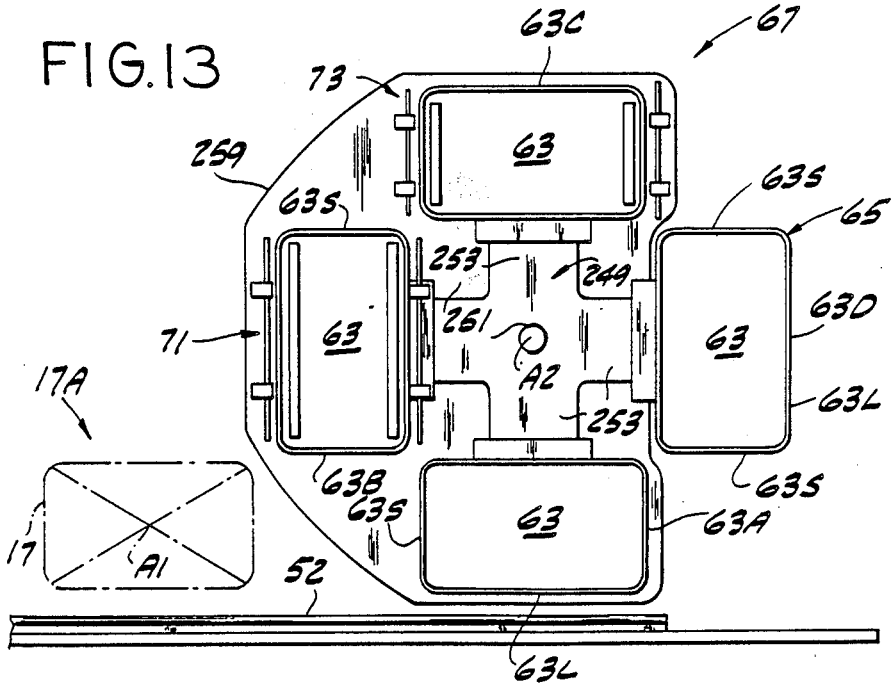
FIG. 13 is a view generally on line 13—13 of FIG. 10.

The wheel 65 having the four compartments 63, each for receiving from the carrier 17 at station S2 a bag 1 with the stack 11 and closure panel 47 therein, comprises a hub 249 mounted on a shaft 251 for rotation about the horizontal axis A2 directly above and parallel to the axis A1 of the carrier at station S2. The hub may be of cruciform shape as shown in FIG. 13, having four arms 253 spaced at 90° intervals around its axis for supporting the four compartments. Each compartment 63 comprises an open-ended generally rectangular box, the long sides of the box being designated 63L and the short sides 63S, and the box having rounded corners. Each box is dimensioned for a generally close fit therein of a bag 1 with the stack 11 and the panel 47 in the bag. Each box is open at its front and rear ends, its front end (toward station S2) being flared as indicated at 255 for, in effect, funnelling the loaded bag thereinto as the loaded bag is pushed forward by the ram means 45.

As noted above, the indexing drive 69 (which may be of any well-known type) for the wheel 65 is operable intermittently to rotate the wheel in 90° steps to index each of the compartments or boxes 63 from the bag receiving position or station 63A in line with the carrier 17 at station S2 to the first flap folding and sealing position or station 63B, thence to the second flap folding and sealing position or station 63C, thence to the discharge position or station 63D, and thence back to the bag receiving position or station 63A for repeating the four-step cycle. Each compartment or box 63 is mounted on the respective arm 253 of the wheel hub 251 with its long sides 63L in crosswise position at right angles to the radial center line of the respective arm. Thus, when a box 63 is in its stated bag receiving position 63A, which is its lower position, its long sides 63L are horizontal and its short sides 63S are vertical (see FIG. 13). The long side 63L which is uppermost is essentially coplanar with the top of the carrier 17 at station S2, and the lower long side 63L is essentially coplanar with the bottom of the carrier 17 at station S2. The short sides are essentially coplanar with the sides of the carrier 17 at station S2. When a box is at position 63B, which is its left side position as viewed in FIG. 13, its long sides 63L are vertical and its short sides 63S horizontal. When a box is at position 63B, which is its top position, its long sides 63L are horizontal and its short sides 63S are vertical. And when a box is at position 63D, which is its right side position as viewed in FIG. 13, its long sides 63L are vertical and its short sides 63S are horizontal.

Figure 28:
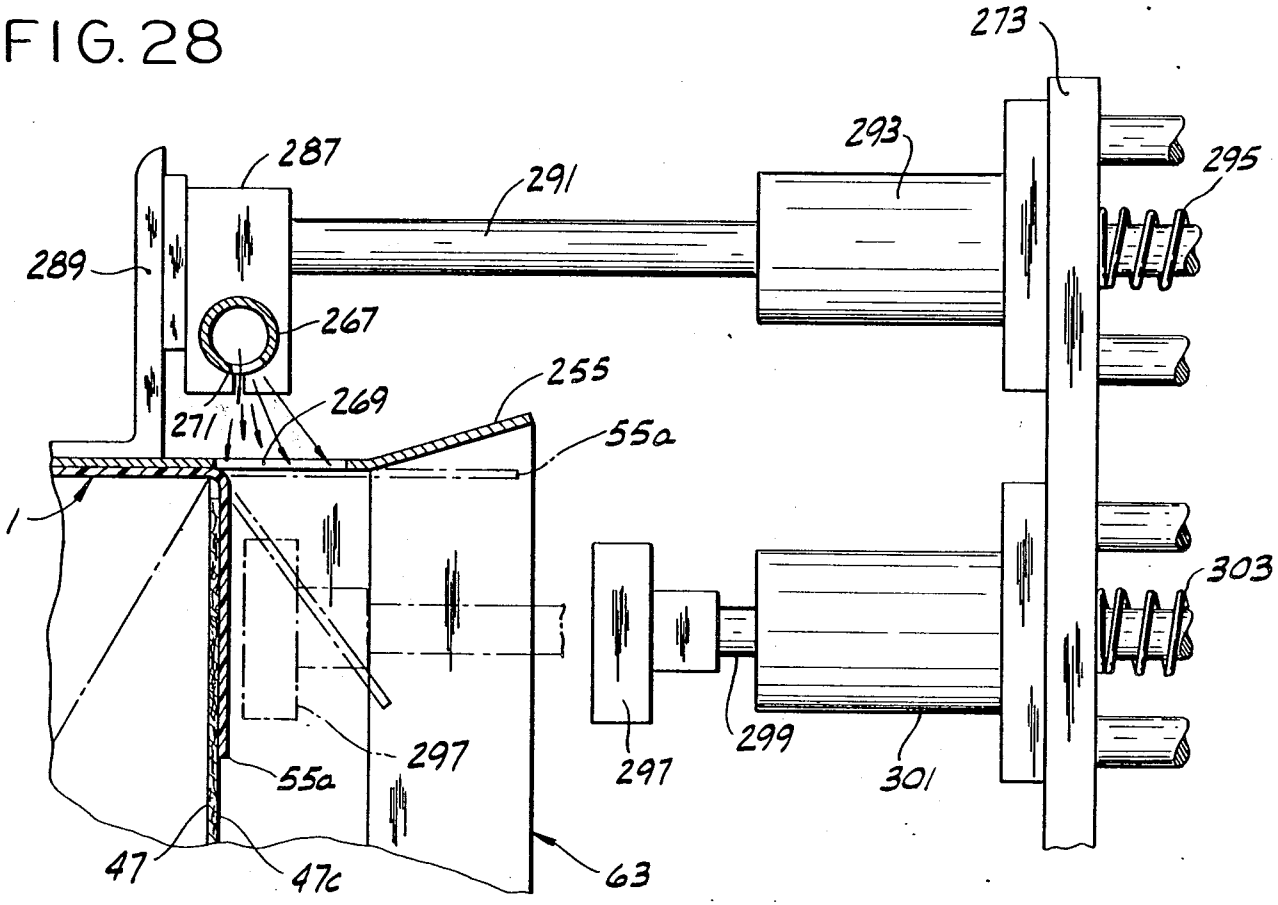
FIG. 28 is a view in section generally on line 28—28 of FIG. 26 and enlarged, showing how a flap is folded over by blowing air on it.

A stop plate indicated at 259 in FIGS. 10–13 backs the wheel 65 at index positions 63A, 63B and 63C for closing the rear ends of the boxes (their ends away from station S2) at these three index positions. The rear end of each box is open at index position 63D for the discharge of a completed package as will appear. Each box 63 is slightly longer than the length of a bag 1 surrounding the stack 11 and end panel 47 with the lip 15 providing the four marginal portions of the bag at the mouth of the bag constituting the flaps 55*a*, 57*a*, 59*a* and 61*a* at each of the four edges of the panel 45. Generally, the closure end of a loaded bag 1, pushed into a box 63 at index position 63A, engages the stop plate 259 and is received in the box with the lip 15 within the box adjacent its flared end 255, the edge of the lip being just within the end of the box (see FIG. 28).

After the loaded bag has been introduced into the box 63 at position 63A, the wheel 65 is indexed 90° to bring the box with the loaded bag therein to position 63B where the aforesaid means 71 is provided (see FIGS. 10, 11, 13 and 24–26) for folding over the flaps 55*a* and 59*a* (the long flaps) of the bag and heat sealing them to the outside of panel 47 in the bag. As herein illustrated, this means 71 comprises means indicated generally at 263 for blowing air on the flaps 55*a* and 59*a* to fold them over on the outside coated face 47*c* of the panel 47, and heat sealing bar means indicated generally at 265 operable on folding said long flaps over to heat seal them to the panel.

The air blowing folding means 263 comprises a pair of vertically extending air tubes 267 associated with station 63B mounted for movement between a retracted position relative to the wheel 65 wherein the tubes are clear of the wheel to enable the indexing of the wheel, and an operative position wherein they extend vertically on opposite sides of the box 63 which is in position 63B in register with openings 269 (see FIG. 28) in the sides of the box adjacent the flared end 255 of the box. The air tubes have air outlets 271 for blowing air through the openings 269 to impinge on the two long side flaps 55*a* and 59*a* of the bag 1 in the box 63 at position 63B to blow these flaps over on the outside of the panel 47. In detail, the air tubes are carried by a carriage constituted by a plate 273 facing the flared end 255 of the box 63 at position 63B mounted for movement toward the end 255 of the box at position 63B from a retracted position to move the tubes 267 from their retracted position to their operative flap-folding position. The carriage plate 273 is mounted at the forward end of a slider 275 guided for horizontal reciprocation by means of guide rollers as indicated at 277 in a frame 279 located adjacent the face of the wheel 65 defined by the entry ends 255 of the boxes 63. An air cylinder C14 mounted in the frame has its piston rod 283 connected to the slider 275 as indicated at 285 for reciprocating the slider to reciprocate the carriage plate 273 back and forth between its retracted position and an advanced position. Each of the two air tubes 267 is mounted on the plate 273 in such manner and in such position as to be movable forward with the plate 273 into its air blowing position determined by engagement of upper and lower clamps 287 which hold the tube with a limit stop 289 on the respective long side of the box 63 at position 63B. Each of the tube clamps 287 is at the forward end of a horizontal rod 291 slidable in a guide 293 on the carriage plate 273, the rod acting against a spring 295 for yielding on engagement of the tube clamp 287 with the stop 289.

The heat sealing bar means 265 comprises a pair of vertically extending relatively long heat sealing bars 297 associated with station 63B mounted on carriage plate 273 for movement therewith between a retracted position relative to the wheel 65 wherein the bars are clear of the wheel to enable the indexing of the wheel, and an operative position wherein they engage the folded-over long flaps 55*a* and 59*a* of the loaded bag 1 in the box 63 at station 63B for heat sealing said long flaps to the outside (heat-sealable) face 47*c* of the panel 47 in the bag. Each heat sealing bar 297 extends vertically between the forward ends of upper and lower rods 299 slidable in upper and lower guides 301 on plate 273, these rods acting against springs 303 for yielding on engagement of the heat sealing bars 297 with the flaps 55*a*, 59*a*. A presser plate 305 carried by a rod 307 slidable in a guide 309 on the plate 273 acting against a spring 310 is provided for pressing the panel 47 against the stack 11 in the bag 1 as the plate 273 is moved forward.

After the long flaps 55*a* and 59*a* have been folded over and sealed at position 63B, the wheel 65 is indexed 90° to bring the box with the bag therein to position 63C where the aforesaid means 73 is provided (see FIGS. 10, 11, 13, 24, 25 and 27) for folding over the flaps 57*a* and 61*a* (the short flaps) of the bag and heat sealing them to the outside of panel 47 in the bag. As herein illustrated, this means 311 is similar to means 71 comprising means indicated generally at 313 for blowing air on the flaps 57*a* and 61*a* to fold them over on the outside of the panel 47, and heat sealing bar means indicated generally at 315 operable on folding said short flaps over to heat seal them to the panel.

The air blowing folding means 313 for the short flaps comprises a pair of vertically extending air tubes 317 associated with station 63C mounted for movement between a retracted position relative to the wheel 65 wherein the tubes are clear of the wheel to enable the indexing of the wheel, and an operative position wherein they exend vertically on opposite sides of the box 63 which is in position 63C in register with openings similar to openings 269 in the box adjacent the end 255 of the box. The tubes have air outlets similar to outlets 271 for blowing air through the openings to impinge on the two short side flaps 57*a* and 61*a* of the bag 1 in the box 63 at position 63C to blow these flaps over on the outside of the panel 47. In further detail, the air tubes 317 are carried by a carriage constututed by a plate 323 facing the flared end 255 of the box 63 at position 63C mounted for movement toward the end 255 of the box at position 63C from a retracted position to move the tubes 317 from their retracted position to their operative flap-folding position. The carriage plate 323 is mounted at the forward end of a slider 325 guided for horizontal reciprocation by means of guide rollers as indicated at 327 in frame 279 located adjacent the face of the wheel 65 defined by the entry ends 255 of the boxes 63. An air cylinder C15 mounted in the frame has its piston rod 333 connected to the slider 325 as indicated at 335 for reciprocating the slider to reciprocate the carriage plate 323 back and forth between its retracted position and an advanced position. Each of the two air tubes 317 is mounted on the plate 323 in such manner and in such position as to be movable forward with the plate 323 into its air blowing position determined by engagement of upper and lower tube-holding clamps 337 with a limit stop 339 on the respective short side of the box 63 at position 63C. Each of the tube clamps 337 is at the forward end of a horizontal rod 341 slidable in a guide 343 on the carriage plate 323, the rod acting against a spring 345 for yielding on engagement of the tube clamp 337 with the stop 339.

The heat sealing bar means 315 comprises a pair of vertically extending relatively short heat sealing bars 347 associated with station 63C mounted on carriage plate 323 for movement therewith between a retracted position relative to the wheel 65 wherein the bars are clear of the wheel to enable the indexing of the wheel, and an operative position wherein they engage the folded-over short flaps 57*a* and 61*a* of the loaded bag 1 in the box 63 at station 63C for heat sealing said short flaps to the outside (heat-sealable) face 47*c* of the panel 47 in the bag. Each heat sealing bar 347 extends vertically between the forward ends of upper and lower rods 349 slidable in upper and lower guides 351 on plate 323, these rods acting against springs 353 for yielding on engagement of the heat sealing bars 347 with the flaps 57*a* and 61*a*. A presser plate 355 carried by a rod 357 slidable in a guide 359 on the plate 323 acting against a spring 361 is provided for pressing the panel 47 against the stack 11 in the bag 1 as the plate 323 is moved forward.

Figure 9:
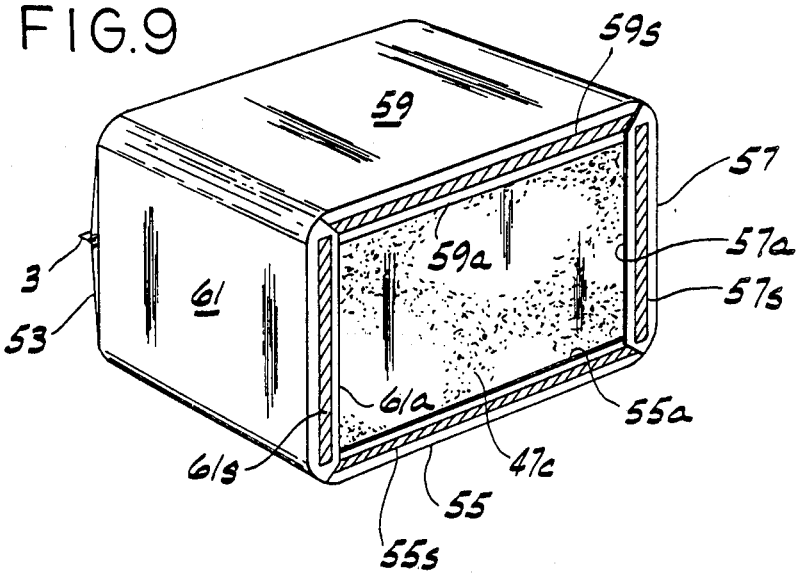
FIG. 9 is a perspective of the completed package or bundle comprising the bag, the product and the end closure panel with the flaps as folded over and sealed to the panel at the folding and sealing stations illustrated in FIGS. 6 and 8.

The sealing of the short side flaps 57*a*, 61*a* to the panel 47 at station 63C completes the formation of the package P as shown in FIG. 9 with seals 55*s*, 59*s* for the long flaps and seals 57*s* and 61*s* for the long flaps. The wheel 65 is then indexed 90° to bring the box 63 with the completed package P therein to the discharge station 63D, at the right side of the wheel, and the package is discharged through the rear end of the box 63 on to a discharge chute 363 by a pusher 365 operable by an air cylinder C16 (see FIG. 12).

Figure 29:
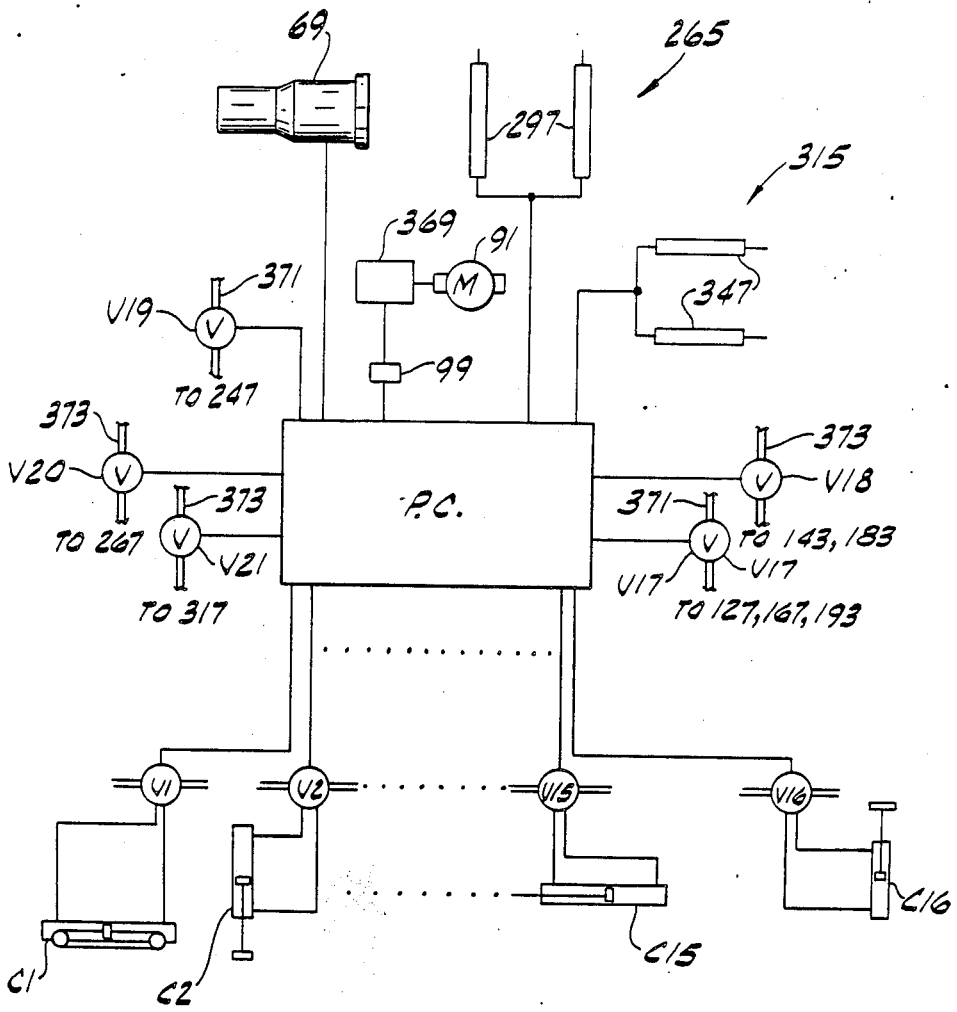
FIG. 29 is a pneumatic and electrical circuit diagram.

Referring to FIG. 29, the air cylinders C1–C16 are illustrated as being controlled by solenoid valves Vl–V16 which are under the control of a programmable controller 367 for carrying out the operation of the cylinders in the appropriate sequence as will appear. The motor 91 for driving the feed rolls 81, 83 and the belt conveyor 87 is controlled by a motor controller 369 under the control of the programmable controller, as well as under control of the sensor 99. At 371 is indicated a source of vacuum for the vacuum manifolds 127, 167 and 195 (and hence the vacuum grippers 121, 161 and 193) and at V17 is indicated a solenoid valve controlled by the programmable controller for controlling the connection of vacuum to these vacuum manifolds. At 373 is indicated a source of compressed air for the air motors 143 and 183 and the air tubes 267 and 317. At V18 is indicated a solenoid valve for controlling delivery of compressed air to the motors 143 and 183. AT V19 is indicated a solenoid valve for controlling connection of the vacuum source 371 to the vacuum grippers 247 for picking up a panel 47. At V20 and V21 are indicated solenoid valves for controlling delivery of compressed air to the air blast tubes 267 and 317, respectively. These valves are under control of the programmable controller. FIG. 29 also shows the sealing bars 297 and 347 as under the control of the programmable controller.

Operation of the apparatus through a cycle for production of each package P may be regarded as starting with the C-shaped yoke or carriage 111 in its retracted position, in which it is shown in solid lines in FIG. 14, for gripping and opening a bag 1. The lower manifold 127 is down at the start, retracted by cylinder C5, so that the lower vacuum grippers 121 and lower clamp jaws 137 (left and right) are somewhat below the level of the upper reach of the conveyor 87 to clear the way for feeding the leading end of the tubing T (its right-hand end as viewed in FIG. 14) over the lower vacuum grippers and the lower clamp jaws 137. The swingable clamp arms 139 are not only down with the lower manifold, but also in their swung-out open position. The upper manifold is up in its raised position of FIGS. 14, 19 and 21, retracted by cylinder C7, so that the upper vacuum grippers 161 and upper clamp jaws 177 are well above the level of the upper reach of the conveyor. The swingable clamp arms 179 are in their swung-out open position. The auxiliary bag pickup vacuum grippers 193 are up. The tubular carrier 17 is at station S1, in position to receive a bag. The programmable controller 367 then effects operation of the apparatus through a sequence of steps generally as follows:

A. Motor 91 is energized to drive the feed rolls 81, 83 and the belt conveyor 87 to feed tubing T toward the right as viewed in FIG. 14 from the roll of tubing RT. The motor is cut off and the feed of the tubing is terminated by the sensor 99 sensing the arrival of the leading end of the tubing (its right end as viewed in FIG. 14) over the lower vacuum grippers 121. The feed of the tubing stops with a length of tubing somewhat longer than the length for a bag 1 extending forward from the feed rolls 81, 83 over the upper reach of the belt conveyor 87 with an open end of the tubing under the sensor 99 and a line of perforations 9 at station 100 in register with slots 105 in clamp bars 103 and 101 between the feed rolls and the upstream end of the belt conveyor.

B. Valve V2 is energized to actuate the pair of cylinders C2 (see FIG. 15) to drive down the upper clamp bar 103 thereby to clamp the tubing between clamp bars 103 and 101. The top of bar 101 is generally in the pass plane of the feed rolls 81, 83 and flush with the upper surface of conveyor 87.

C. Valve V3 is energized to actuate cylinder C3 to drive the cutting blade 104 up to cut through the tubing at the line of perforations 9. This separates the bag 1 from the tubing with the bag occupying the bag pick-up position 1A (see FIGS. 14 and 20). Valve V3 is deenergized to retract the blade, and valve V2 is deenergized to retract the clamp bar 103.

D. Cylinder C5 is actuated to raise the lower manifold 127 and the lower sets of gripper units 119L and 119R to their up position of FIG. 20 generally flush with the upper surface of conveyor 87 for interengagement of the vacuum grippers 121 and the bottom face of the bottom wall of the bag at the mouth end of the bag.

E. Cylinder C7 is actuated to lower the upper manifold 167 and the upper sets of gripper units 159L and 159R to their lowered position of FIG. 20 for interengagement of the upper vacuum grippers 161 with the upper face of the upper wall of the bag at the mouth end of the bag (directly above the lower vacuum grippers 121).

F. Cylinder C9 is actuated to drive the auxiliary bag pickup vacuum grippers 193 down into engagement with the top wall of the bag in the 1A position.

G. The vacuum valve V17 is actuated to pull a vacuum in the vacuum grippers 121 and 161 so that the grippers 121 grip the lower wall of the bag at its mouth for holding it down and the upper grippers 161 grip the upper wall of the bag at its mouth for pulling it up away from the lower wall. A vacuum is also pulled in the auxiliary grippers 193 for gripping the top wall of the bag adjacent its closure end (its left end as viewed in FIG. 14).

H. Cylinder C7 is actuated to raise the upper manifold 167 which carries the vacuum grippers 161, and cylinder C9 is actuated to raise the auxiliary grippers 193. With the lower wall of the bag held down at the mouth of the bag by the lower vacuum grippers 121, the bag is opened up as appears in FIG. 21 for the sleeving of the bag on the carrier 17 at station S1.

I. Cylinders C6 are actuated to move the clamp arms 139 up and cylinders C8 are actuated to move the clamp arms 179 down, thereby bringing the arms 139 to a level above the lower wall of the opened-up bag and the arms 179 to a level below the upper wall of the opened-up bag.

J. Motors 143 are actuated (by valve V18) to swing the clamp arms 139 into the mouth of the opened-up bag over the lower wall of the bag and motors 183 are actuated (also by valve V18) to swing the clamp arms 179 into the mouth of the bag under the upper wall of the bag.

K. Cylinders C6 are actuated to pull the clamp arms 139 down for mechanically gripping the lower wall of the bag at its mouth and cylinders C8 are actuated to pull the clamp arms 179 up for mechanically gripping the upper wall of the bag at its mouth (see FIG. 21).

L. Cylinder C4 is actuated to drive the yoke or carriage 111 from its retracted solid-line position of FIG. 14 (also its position shown in FIG. 21) to its advanced position shown in phantom in FIG. 14. As the carriage 111 moves from its retracted to its advanced position, straddling the carrier 17 (top, bottom and one side), it pulls the bag on to the carrier, i.e. it ensleeves the bag on the carrier. FIG. 14 illustrates a bag so sleeved on the carrier (see also FIGS. 2 and 4).

M. Upon the sleeving of the bag on the carrier 17, cylinders C6 are actuated to raise the clamp means 139 sufficiently for their separation from the lower wall of the bag, and cylinders C8 are actuated to lower the clamp arms 179 sufficiently for their separation from the upper wall of the bag.

N. Vacuum valve V17 is deactuated to cut off the vacuum in the grippers 121, 161 (and 193).

O. Motors 143 and 183 are actuated to swing the arms 139 and 179 out of the bag mouth.

P. Cylinder C5 is actuated to move the arms 139 down below the bottom of carrier 17 (below the lower wall of the bag sleeved on the carrier), and cylinder C7 is actuated to move the arms 179 up above the top of the carrier (above the upper wall of the bag).

Q. Cylinder C4 is actuated to retract the carriage 111 back to its FIG. 14 solid-line position, the carriage and the gripper units carried thereby then being ready for the next cycle.

R. With the bag ensleeved on the carrier 17 at station S1, cylinder C10 is actuated to operate the pusher 43 to push the stack 11 which has been collated at 41 (by conventional collating means) into the carrier 17. As the stack slides forward in the carrier, it expands the carrier by pushing the swingable side walls 25 of the carrier outwardly as indicated in phantom in FIG. 3 thereby to stretch the bag on the carrier. Air which might otherwise be trapped between the end 11*a* of the stack and the bottom 53 of the bag is vented via passages 37.

S. Cylinder C10 is actuated to retract the pusher 43, clearing the carrier 17 for traverse from station S1 to S2 (and placing the pusher in readiness for the next cycle).

T. Cable cylinder C1 is actuated to traverse the carrier 17 with the bag 1 thereon and the stack 11 therein from station S1 to station S2, where the carrier is located in line with the compartment or box 63 of the wheel 65 which is in position 63A and between that box and the panel-inserting and ram means 45. The latter will have been prepared for inserting a panel 47 in the carrier 17 at station S2 (and following through to push the stack 11 out of the carrier and to push the bag off the carrier via the exit of the stack from the carrier) by a previous operation involving:

(1) Actuation of cylinder C13 to swing the head 209 of means 45 to its down-facing panel pick-up position illustrated in phantom in FIG. 23.

(2) Actuation of cylinder C11 to drive the elevator 217 down for engagement of vacuum grippers 247 associated with head 209 with the top panel 49 of the stack of panels.

(3) Actuation of vacuum valve V19 to pull a vacuum in grippers 247 for gripping the top panel of the stack. The panels are stacked with their coated faces 47*c* down.

(4) Actuation of cylinder C11 to drive the elevator 217 back up to its solid-line position of FIG. 23 in line with carrier 17 at station S2.

(5) Actuation of cylinder C13 to swing the head 209 (carrying the picked-up panel 47) to its solid-line vertical position of FIG. 23.

U. Cylinder C12 is actuated to drive forward the head 209 carrying the panel 47 in vertical position for insertion in the carrier 17 at station S2. The panel engages the end 11*b* of the stack 11 in the carrier, the vacuum grippers 247 yield back into their recess, the head 209 engages the outside face of the panel (which is its coated face 47*c*), and continues moving forward to push against the panel thereby to push the stack 11 out of the carrier 17. As the stack exits from the carrier, it pushes against the spread-out bottom 53 of the bag 1 on the carrier. The stack is pushed, in one continuous movement of the head 209, completely out of the carrier 17. The bag, pushed off the carrier by the stack, comes off the carrier surrounding the stack. As the bag comes off the carrier, it contracts on the stack. In this regard, it is to be noted that the bag is stretchable and was stretched on the carrier by the expansion of the carrier by the stack as the stack was pushed into the carrier at station S1. The bag, coming off the carrier 17 at station S2 with the stack and panel 47 therein, enters the compartment or box 63 of the wheel 65 at position 63A, coming to a position within the box with its bottom 53 against the stop plate 259 and with the mouth end of the bag and the panel 47 adjacent the flared end 255 of the box (as illustrated in FIG. 11).

V. Cylinder C12 is actuated to retract the head 209 from the carrier at station S2, and the panel inserting and ram means is put through its routine T(1)–T(5) as above described to pick up a panel 47 from the stack 49 in preparation for the next cycle.

W. The cable cylinder C1 is actuated to traverse the carrier 17 back to station S1 for the next cycle.

X. The index mechanism 69 is actuated to index the wheel 90° (clockwise as viewed in FIG. 13) to transfer the bag 1 with the stack 11 and panel 47 therein from position 63A to the first folding and sealing station 63B.

Y. Cylinder C14 is actuated to drive the carriage plate 273 forward (toward the left as viewed in FIG. 25) to bring the air blast tubes 267 to their operative position of FIG. 26 (also illustrated in FIG. 28) as determined by engagement of the tube holding clamps 287 with the limit stops 289.

Z. Air valve V20 is actuated to deliver air to the tubes 267, the air blasting out through openings 271 in the tubes and impinging on the long flaps **55*a* and 59*a* at the mouth of the bag 1 through the openings 269 in the long sides of the box at station 63B to blow these flaps over around the long edges of the panel 47 in the bag on to the outside face, which is the coated face 47*c***, of the panel.

AA. Forward movement of the carriage plate 273 by cylinder C14 is continued, as permitted by the sliding of rods 291 against the bias of springs 295. The presser plate 305 engages the outside face of the panel 47 and compresses the stack 11 (acting against the stop plate 259). After engagement of the presser plate with the panel 47, the carriage plate 273 continues to move farther forward, as permitted by the sliding of rods 291 against the bias of springs 295 and the sliding of rods 299 against the bias of springs 303, and the long heat sealing bars 297 engage the long flaps **55*a* and 59*a*. Valve V20 is deactuated to cut off the air blast. Bars 297, in pressure engagement with the long flaps, are heated (under suitable control as by the programmable controller) for a sealing interval to effect heat sealing of the long flaps to the coated outside face 47*c* of the panel 47**.

BB. Cylinder C14 is actuated to retract the carriage plate 273, thereby moving the air tubes 267, the heat sealing bars 297 and the presser plate 305 back to their retracted position for the next cycle, and clearing the wheel 65 to permit its rotation.

CC. The index mechanism 69 is actuated to index the wheel 90° (again clockwise as viewed in FIG. 13) to bring the bag 1 with the long flaps **55*a* and 59*a* sealed to panel 47 to the second folding and sealing station 63C**.

DD. Cylinder C15 is actuated to drive the carriage plate 323 forward (toward the left as viewed in FIG. 25) to bring the air blast tubes 317 to their operative position illustrated in FIG. 24) as determined by engagement of the tube holding clamps 337 with the limit stops 289.

EE. Air valve V21 is actuated to deliver air to the tubes 317, the air blasting out through the air exit openings in these tubes and impinging on the short flaps **57*a* and 61*a* at the mouth of the bag 1 through the openings in the short sides of the box at station 63C to blow these flaps over around the short edges of the panel 47 in the bag on to the outside coated face 47*c*** of the panel.

FF. Forward movement of the carriage plate 323 by cylinder C15 is continued, as permitted by the sliding of rods 341 against the bias of springs 345. The presser plate 355 engages the outside face of the panel 47 and compresses the stack 11 (acting against the stop plate 259). After engagement of the presser plate 355 with the panel 47, the carriage plate 323 continues to move farther forward, as permitted by the sliding of rods 341 against the bias of springs 345 and the sliding of rods 349 against the bias of springs 353, and the short heat sealing bars 347 engage the short flaps **57*a* and 61*a*. Valve V21 is deactuated to cut off the air blast. Bars 347, in pressure engagement with the short flaps, are heated (under suitable control as by the programmable controller) for a sealing interval to effect heat sealing of the short flaps to the outside face of the panel 47**. This completes the formation of a package P.

GG. Cylinder C15 is actuated to retract the carriage plate 323, thereby moving the air tubes 317, the heat sealing bars 347 and the presser plate 355 back to their retracted position for the next cycle, and clearing the wheel 65 to permit its rotation.

HH. The index mechanism 69 is actuated to index the wheel 90° (again clockwise as viewed in FIG. 13) to transfer the completed package P to the ejection or discharge station 63D.

II. Cylinder C16 is actuated to drive the pusher or ejector 365 forward to push the completed package P out of the box 63 at station 63D, the package sliding down the discharge chute 363.

JJ. Cylinder C16 is actuated to bring the pusher 365 back to its retracted position for the next cycle, clearing the wheel 65 to permit its rotation. This completes a cycle.

It will be understood that each successive cycle of operation (a cycle being as above described and involving operations A–JJ) may be instigated (by the programmable controller 367) before the completion of the preceding cycle, noting that a bag 1 may be applied to the carrier 17 when the carrier returns to station S1. Thus, a bag may be applied to the carrier 17 at station S1 and a stack 11 loaded into the carrier while the flap folding and sealing operations are being carried out in zone 67.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. The method of packaging product having first and second ends in a bag of flexible packaging material formed with a first end closure at one end and an open mouth at the other, comprising:

loading the bag with product with the first end of the product at said first end closure of the bag;

the length of the bag and the length of the product being such that, with said first end of the product at said first end closure of the bag, the bag has a lip all around it at its mouth projecting beyond the product;

inserting a closure panel in the bag to lie against the second end of the product; and pushing against the closure panel to push against the product and push the bag with the product and closure panel therein endwise to a transfer position, and further transferring the bag with the product and closure panel therein away from said transfer position and folding over and sealing the lip to the panel.

2. The method of claim 1 wherein the insertion of the panel and the pushing thereof and the product are carried out in one continuous movement.

3. The method of claim 1 wherein the further transfer of the bag with the product and panel therein involves the lateral transfer thereof from said transfer position to lip folding and sealing means for the folding and sealing of the lip.

4. The method of claim 1 wherein the bag with the product and panel therein is transferred from its said transfer position successively to a number of lip folding and sealing stations for the folding and sealing of the lip.

5. The method of claim 1 wherein the product is of generally rectangular cross section and the panel is of corresponding shape, the lip providing four marginal portions of the bag at the mouth of the bag constituting flaps at each of the four edges of the panel, each flap at any point thereof being of relatively narrow width substantially less than half the distance across the panel from said point, and wherein the bag with the product and panel therein is transferred from its said transfer position to a first folding and sealing station where the flaps at two opposite sides are folded over and sealed to the panel, and then transferred to a second folding and sealing station where the flaps at the other two opposite sides are folded over and sealed to the panel.

6. The method of claim 1 wherein the bag is sleeved endwise on a carrier which is open at both ends with the bag closure at one end of the carrier, the product is loaded in the carrier, the panel is inserted in the other end of the carrier, and said pushing against the panel pushes the product out of the carrier and the product pushes the bag off the carrier, the bag coming off the carrier surrounding the product.

7. The method of claim 6 wherein the bag with the product and panel therein involves the lateral transfer thereof from said transfer position to lip folding and sealing means for the folding and sealing of the lip.

8. The method of claim 6 wherein the bag with the product and panel therein is transferred from its said transfer position successively to a number of lip folding and sealing stations for the folding and sealing of the lip.

9. The method of claim 6 wherein the product is of generally rectangular cross section and the panel is of corresponding shape, the lip providing four marginal portions of the bag at the mouth of the bag constituting flaps at each of the four edges of the panel, each flap at any point thereof being of relatively narrow width substantially less than half the distance across the panel from said point, and wherein the bag with the product and panel therein is transferred from its said transfer position to a first folding and sealing station where the flaps at two opposite sides are folded over and sealed to the panel, and then transferred to a second folding and sealing station where the flaps at the other two opposite sides are folded over and sealed to the panel.

10. The method of packaging product having first and second ends in a bag of flexible packaging material formed with a first end closure at one end and an open mouth at the other, comprising:

loading the bag with product with the first end of the product at said first end closure of the bag;

the length of the bag and the length of the product being such that, with said first end of the product at said first end closure of the bag, the bag has a lip all around it at its mouth projecting beyond the product;

inserting a closure panel in the bag to lie against the second end of the product; and pushing against the closure panel to push against the product and push the bag with the product and closure panel therein endwise to a position for transfer thereof for folding over and sealing the lip to the panel, wherein the bag is sleeved endwise on a carrier which is open at both ends with the bag closure at one end of the carrier, the product is loaded in the carrier, the panel is inserted in the other end of the carrier, and said pushing against the panel pushes the product out of the carrier and the product pushes the bag off the carrier, the bag coming off the carrier surrounding the product wherein the bag is sleeved endwise on the carrier and product is entered in the carrier at a loading station, and the carrier with the bag thereon and the product therein is moved to a panel inserting station where the panel is inserted, the product pushed out of the carrier and the bag pushed off the carrier by the product.

11. The method of claim 10 wherein the bag with the product and panel therein is transferred from its said position to lip folding and sealing means for the folding and sealing of the lip.

12. The method of claim 11 wherein the bag with the product and panel therein is transferred from its said position successively to a number of lip folding and sealing stations for the folding and sealing of the lip.

13. The method of claim 12 wherein the product is of generally rectangular cross section and the panel is of corresponding shape, the lip providing four marginal portions of the bag at the mouth of the bag constituting flaps at each of the four edges of the panel, each flap at any point thereof being of relatively narrow width substantially less than half the distance across the panel from said point, and wherein the bag with the product and panel therein is transferred laterally from its said position to a first folding and sealing station where the flaps at two opposite sides are folded over and sealed to the panel, and then transferred laterally to a second folding and sealing station where the flaps at the other two opposite sides are folded over and sealed to the panel.

14. The method of claim 6 wherein the bag is stretchable and is stretched on the carrier as sleeved thereon, the bag contracting on the product as the bag comes off the carrier.

15. The method of claim 6 for packaging product comprising a stack of rolls of paper wherein a plurality of rolls are collated in a stack and the stack is pushed into the carrier.

16. The method of packaging product having first and second ends in a bag of flexible packaging material formed with a first end closure at one end and an open mouth at the other comprising:

loading the bag with product with the first end of the product at said first end closure of the bag;

the length of the bag and the length of the product being such that, with said first end of the product at said first end closure of the bag, the bag has a lip all around it at its mouth projecting beyond the product;

inserting a closure panel in the bag to lie against the second end of the product; and pushing against the closure panel to push against the product and push the bag with the product and closure panel therein endwise to a position for transfer thereof for folding over and sealing the lip to the panel, wherein the bag with the product and panel therein is transferred from its said position to lip folding and sealing means for the folding and sealing of the lip, and wherein the bag with the product and panel therein is moved laterally with respect to the bag from said position to said lip folding and sealing means.

17. The method of claim 16 wherein the bag with the product and panel therein is moved in a circular path to said lip folding and sealing means.

18. The method of claim 4 wherein the bag with the product and panel therein is moved laterally with respect to the bag to said lip folding and sealing stations.

19. The method of claim 18 wherein the bag with the product and panel therein is moved in a circular path to said lip folding and sealing stations.

20. The method of claim 13 wherein the bag with the product and panel therein is rotatably indexed about an axis generally parallel to and spaced from the bag axis to said first and second lip folding and sealing stations.

21. Apparatus for packaging product having first and second ends in a bag of flexible packaging material formed with a first end closure at one end and an open mouth at the other, comprising:

means for loading the bag with product with the first end of the product at said first end closure of the bag;

the length of the bag and the length of the product being such that, with said first end of the product at said first end closure of the bag, the bag has a lip all around it at its mouth projecting beyond the product; and means for inserting a closure panel in the bag to lie against the second end of the product and for pushing against the closure panel to push against the product and push the bag with the product and closure panel therein endwise to a transfer position, and means for further transferring the bag with the product and closure panel therein away from said transfer position and for folding over and sealing the lip to the panel.

22. Apparatus as set forth in claim 21 wherein the means for inserting and pushing against the closure panel is operable to effect said inserting and pushing in one continuous movement.

23. Apparatus as set forth in claim 21 having means for folding and sealing the lip, and means for transferring the bag with the product and panel therein laterally from said transfer position to said lip folding and sealing means.

24. Apparatus as set forth in claim 21 having a number of lip folding and sealing stations, and means for transferring the bag with the product and panel therein from said transfer position successively to said stations for the folding and sealing of the lip.

25. Apparatus as set forth in claim 21 for packaging product of generally rectangular cross section, the panel being of corresponding shape, the lip providing four marginal portions of the bag constituting flaps at each of the four edges of the panel, each flap at any point thereof being of relatively narrow width substantially less than half the distance across the panel from said point, said transfer apparatus having means for transferring the bag with the product and panel therein from said position first to a first folding and sealing station and then to a second folding and sealing station, means at the first folding and sealing station for folding over and sealing to the panel the flaps at two opposite sides of the bag, and means at the second folding and sealing station for folding over and sealing to the panel the flaps at the other two opposite sides of the bag.

26. Apparatus as set forth in claim 21 further having a carrier which is open at both ends on which the bag is sleeved endwise with the bag closure at one end of the carrier and in which the product is loaded, said panel inserting means inserting the panel in the other end of the carrier and said pushing against the panel pushing the product out of the carrier and the product pushing the bag off the carrier, the bag coming off the carrier surrounding the product with the panel therein and moving to said position.

27. Apparatus as set forth in claim 26 having means for transferring the bag with the product and panel therein laterally from said transfer position to a lip folding and sealing station, and having means at the latter station for folding and sealing the lip.

28. Apparatus as set forth in claim 26 having a number of lip folding and sealing stations, and means for transferring the bag with the product and panel therein from said transfer position successively to said stations for the folding and sealing of the lip.

29. Apparatus as set forth in claim 26 for packaging product of generally rectangular cross section, the panel being of corresponding shape, the lip providing four marginal portions of the bag constituting flaps at each of the four edges of the panel, each flap at any point thereof being of relatively narrow width substantially less than half the distance across the panel from said point, said apparatus having means for transferring the bag with the product and panel therein from said transfer position first to a first folding and sealing station and then to a second folding and sealing station, means at the first folding and sealing station for folding over and sealing to the panel the flaps at two opposite sides of the bag, and means at the second folding and sealing station for folding over and sealing to the panel the flaps at the other two opposite sides of the bag.

30. Apparatus for packaging product having first and second ends in a bag of flexible packaging material formed with a first end closure at one end and an open mouth at the other, comprising:

means for loading the bag with product with the first end of the product at said first end closure of the bag;

the length of the bag and the length of the product being such that, with said first end of the product at said first end closure of the bag, the bag has a lip all around it at its mouth projecting beyond the product; and means for inserting a closure panel in the bag to lie against the second end of the product and for pushing against the closure panel to push against the product and push the bag with the product and closure panel therein endwise to a position for transfer thereof for folding over and sealing the lip to the panel, further having a carrier which is open at both ends on which the bag is sleeved endwise with the bag closure at the end of the carrier and in which the product is loaded, said panel inserting means inserting the panel in the other end of the carrier and said pushing against the panel pushing the product out of the carrier and the product pushing the bag off the carrier, the bag coming off the carrier surrounding the product with the panel therein and moving to said position, and wherein said carrier is movable between a loading station and a panel inserting station, said apparatus having means at the loading station for sleeving a bag on the carrier and loading product therein, said panel inserting means being operable at said panel inserting station following movement of the carrier thereto.

31. Apparatus as set forth claim 30 having means for folding and sealing the lip, and means for transferring the bag with the product and panel therein from its said position to said lip folding and sealing means.

32. Apparatus as set forth in claim 31 having a number of lip folding and sealing stations, and means for transferring the bag with the product and panel therein from its said position successively to said lip folding and sealing stations for the folding and sealing of the lip.

33. Apparatus as set forth in claim 32 for packaging product of generally rectangular cross section, the panel being of corresponding shape, the lip providing four marginal portions of the bag at the mouth of the bag constituting flaps at each of the four edges of the panel, each flap at any point thereof being of relatively narrow width substantially less than half the distance across the panel from said point, said apparatus having means for transferring the bag with the product and panel therein laterally from said position first to a first folding and sealing station and then to a second folding and sealing station, means at the first folding and sealing station for folding over and sealing to the panel the flaps at two opposite sides of the bag, and means at the second folding and sealing station for folding over and sealing to the panel the flaps at the other two opposite sides of the bag.

34. Apparatus as set forth in claim 26 for packaging the product in a bag which is stretchable, said carrier having means for stretching the bag as sleeved thereon, the bag contracting on the product as the bag comes off the carrier.

35. Apparatus as set forth in claim 26 for packaging product comprising a stack of rolls of paper having means for pushing a stack of rolls into the carrier.

36. Apparatus as set forth in claim 33 wherein the means for transferring the bag with the product and panel therein is movable laterally with respect to the bag from said position to said lip folding and sealing means.

37. Apparatus as set forth in claim 36 wherein said transfer means is rotatable about an axis generally parallel to and spaced from the bag axis to move the bag to said lip folding and sealing means.

38. Apparatus for packaging product having first and second ends in a bag of flexible packaging material formed with a first end closure at one end and an open mouth at the other, comprising:

means for loading the bag with product with the first end of the product at said first end closure of the bag;

the length of the bag and the length of the product being such that, with said first end of the product at said first end closure of the bag, the bag has a lip all around it at its mouth projecting beyond the product; and means for inserting a closure panel in the bag to lie against the second end of the product and for pushing against the closure panel to push against the product and push the bag with the product and closure panel therein endwise to a position for transfer thereof for folding over and sealing the lip to the panel, having a number of lip folding and sealing stations, and means for transferring the bag with the product and panel therein from said position successively to said stations for the folding and sealing of the lip, and wherein said transfer means is movable laterally with respect to the bag to said lip folding and sealing stations.

39. Apparatus as set forth in claim 38 wherein said transfer means is rotatable about an axis generally parallel to and spaced from the bag axis to move the bag to said lip folding and sealing stations.

40. Apparatus as set forth in claim 33 wherein the transfer means is rotatably indexable about an axis generally parallel to and spaced from the bag axis to move the bag with the product and panel therein to said first and second lip folding and sealing stations.

41. Apparatus for packaging product having first and second ends in a bag of flexible packaging material formed with a first end closure at one end and an open mouth at the other, comprising:

an open-ended carrier for sleeving of a bag endwise thereon with said first end closure at one open end thereof and for loading product therein through its other open end, said carrier having a longitudinal axis, means for moving the carrier transversely with respect to its longitudinal axis between a first station constituting a bag applying and product loading station and a second station constituting an unloading station;

means for sleeving a bag on the carrier from said one open end thereof with the carrier at said first station;

means for loading product into the carrier from the other open end thereof with the carrier at said first station, the first end of the product being at said first end closure of the bag, the length of the product being such that, with said first end of the product at said first end closure of the bag, the bag has a lip all around it at its mouth projecting beyond the product;

means at said second station for inserting a closure panel in the carrier from said other open end of the carrier to lie against the second end of the product and for pushing against the closure panel to push against the product and push the product out of the carrier, the product coming out of the carrier pushing the bag off the carrier, the bag surrounding the product with the panel therein;

means spaced from the second station for folding the lip over on and sealing it to said panel in the bag; and means for receiving the bag with the product and panel thereon from the carrier at the second station and conveying it to said lip folding and sealing means.

42. Apparatus as set forth in claim 41 wherein said sleeving means comprises means for supplying a bag to a bag pick-up position adjacent said one end of the carrier at said first station, and means for opening up the bag and drawing it over the carrier from said one end of the carrier.

43. Apparatus as set forth in claim 42 wherein said bag supplying means comprises means for feeding bag tubing formed with bag end closures spaced at bag length intervals to bring a bag length of the tubing to said pick-up position, and means for separating from the tubing the bag in said pick-up position at the leading end of the tubing.

44. Apparatus as set forth in claim 41 for packaging product in stretchable bags wherein the carrier is an expansible and contractible carrier which is expanded girthwise by product being loaded thereinto for stretching the bag on the carrier, the bag contracting on the product as the bag comes off the carrier at the second station and the carrier contracting girthwise as the product is pushed out of the carrier.

45. Apparatus as set forth in claim 41 wherein the means at said second station for inserting a panel and pushing the product out of the carrier comprises means for picking up a panel from a stack of panels and inserting the panel in the carrier from its said other open end and being movable through the carrier to push against the panel and thereby push the product out of the carrier.

46. Apparatus as set forth in claim 41 wherein said means for receiving the bag with the product and panel therein and conveying it to said lip folding and sealing means comprises means rotatable about an axis parallel to and spaced from the longitudinal axis of the carrier at said second station, and means for indexing said rotatable means to transfer the bag with the product and panel therein as received from the carrier at said second station to said lip folding and sealing means.

47. Apparatus as set forth in claim 41 for packaging product of generally rectangular cross section, the panel being of corresponding shape, the lip providing four marginal portions of the bag at the mouth of the bag constituting flaps at each of the four edges of the panel, each flap at any point thereof being of relatively narrow width substantially less than half the distance across the panel from said point, said means for receiving the bag with the product and panel therein and conveying it to said lip folding and sealing means comprising a wheel having a series of compartments spaced at intervals therearound for receiving a bag, and means for indexing the wheel to carry each compartment from a position for receiving the bag to a first and thence to a second lip folding and sealing station, said lip folding and sealing means comprising means at the first folding and sealing station for folding over and sealing to the panel the flaps at two opposite sides of the bag, and means at the second lip folding and sealing station for folding over and sealing to the panel the flaps at the other two opposite sides of the bag.

48. Apparatus as set forth in claim 47 wherein the means for indexing the wheel is operable further to index it to carry each compartment to a position for ejection therefrom of a bag with the flaps sealed.

49. Apparatus as set forth in claim 48 wherein the compartments extend parallel to the wheel axis, are open at both ends, and wherein means is provided for closing the ends of the compartments at the back of the wheel away from said second station at the receiving and first and second folding and sealing stations.

50. Apparatus as set forth in claim 49 wherein each folding and sealing means at each of said first and second folding and sealing stations comprises air blowing means movable into a position for blowing air on the flaps to be folded at the respective folding and sealing station, and heat sealing bars movable into position engaging the flaps to be sealed at the respective folding and sealing station.

* * * * *